US011847990B2

(12) United States Patent
Ban et al.

(10) Patent No.: US 11,847,990 B2
(45) Date of Patent: Dec. 19, 2023

(54) DISPLAY DEVICE

(71) Applicant: LG Display Co., Ltd., Seoul (KR)

(72) Inventors: MyungHo Ban, Paju-si (KR); Hyunsuk Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/973,354

(22) Filed: Oct. 25, 2022

(65) Prior Publication Data

US 2023/0206874 A1 Jun. 29, 2023

(30) Foreign Application Priority Data

Dec. 23, 2021 (KR) ..... 10-2021-0186121

(51) Int. Cl.
*G09G 3/36* (2006.01)

(52) U.S. Cl.
CPC ..... *G09G 3/3674* (2013.01); *G09G 2300/0842* (2013.01); *G09G 2310/08* (2013.01); *G09G 2320/02* (2013.01); *G09G 2330/021* (2013.01)

(58) Field of Classification Search
None
See application file for complete search history.

(56) References Cited

U.S. PATENT DOCUMENTS

2007/0183218 A1* 8/2007 Lee ..... G09G 3/3677 365/185.26
2018/0122323 A1* 5/2018 Park ..... H01L 29/7869
2020/0074937 A1* 3/2020 Choi ..... G09G 3/3266

FOREIGN PATENT DOCUMENTS

KR 10-2017-0079997 A 7/2017
KR 10-2019-0009216 A 1/2019
KR 10-1924624 B1 2/2019
KR 10-2102910 B1 4/2020

* cited by examiner

*Primary Examiner* — Christopher J Kohlman
(74) *Attorney, Agent, or Firm* — Birch, Stewart, Kolasch & Birch, LLP

(57) ABSTRACT

A display device can include a left ripple transistor provided in a left stage to remove ripple occurring in a Q node of the left stage, and a right ripple transistor provided in a right stage to remove ripple occurring in a Q node of the right stage. These ripple transistors perform an on operation and an off operation repeatedly and simultaneously.

16 Claims, 8 Drawing Sheets

DISPLAY DEVICE

CROSS-REFERENCE TO RELATED APPLICATIONS

This application claims priority to the Korean Patent Application No. 10-2021-0186121 filed on Dec. 23, 2021 in the Republic of Korea, the entire contents of which are hereby expressly incorporated by reference into the present application.

BACKGROUND OF THE DISCLOSURE

Field of the Invention

The present disclosure relates to a display device.

Discussion of the Related Art

Display devices include liquid crystal display (LCD) devices and light emitting display devices. Each of such display devices can include a display panel which displays an image.

The display devices include a gate driver which includes stages for outputting gate signals to gate lines included in the display panel.

A period, where the stage outputs a gate off signal, can be longer than a period where a gate pulse is output. While the gate off signal is being output, a gate clock for outputting the gate pulse cam be continuously supplied to the stage, and thus, ripple affecting the driving of the stage can occur.

In order to remove an adverse effect of ripple, a state of the related art can include a ripple removal transistor.

However, it can be difficult to normally remove ripple when the ripple removal transistor is degraded. Further, a dummy transistor needs to be added for determining the degree of degradation of the ripple removal transistor, and a voltage supplied to the ripple removal transistor needs to vary based on a degradation in the ripple removal transistor. As a result, various additional elements may be needed.

SUMMARY OF THE DISCLOSURE

Accordingly, the present disclosure is directed to providing a display device that substantially obviates one or more problems due to limitations and disadvantages of the related art.

An aspect of the present disclosure is directed to providing a display device in which a left ripple transistor provided in a left stage to remove ripple occurring in a Q node of the left stage and a right ripple transistor provided in a right stage to remove ripple occurring in a Q node of the right stage perform an on operation and an off operation repeatedly and simultaneously.

Additional advantages and features of the disclosure will be set forth in part in the description which follows and in part will become apparent to those having ordinary skill in the art upon examination of the following or can be learned from practice of the disclosure. The objectives and other advantages of the disclosure can be realized and attained by the structure particularly pointed out in the written description and claims hereof as well as the appended drawings.

To achieve these and other advantages and in accordance with the purpose of the disclosure, as embodied and broadly described herein, there is provided a display device including a display panel including a display area and a non-display area surrounding the display area and including gate lines, a left gate driver provided in a first non-display area of the non-display area to output left gate pulses and left gate off signals to the gate lines, and a right gate driver provided in a second non-display area of the non-display area to output right gate pulses and right gate off signals to the gate lines, wherein the left gate driver includes an $n^{th}$ left stage outputting an $n^{th}$ left gate pulse and the right gate driver includes an $n^{th}$ right stage outputting an $n^{th}$ right gate pulse (where n is a natural number), outputs of the $n^{th}$ left gate pulse and the $n^{th}$ right gate pulse are controlled by Q nodes respectively included in the $n^{th}$ left stage and the $n^{th}$ right stage, and an $n^{th}$ left ripple transistor provided in the $n^{th}$ left stage to remove ripple occurring in an $n^{th}$ left Q node of the $n^{th}$ left stage and an $n^{th}$ right ripple transistor provided in the $n^{th}$ right stage to remove ripple occurring in an $n^{th}$ right Q node of the $n^{th}$ right stage perform an on operation and an off operation repeatedly.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION OF THE EMBODIMENTS

Figure 1:
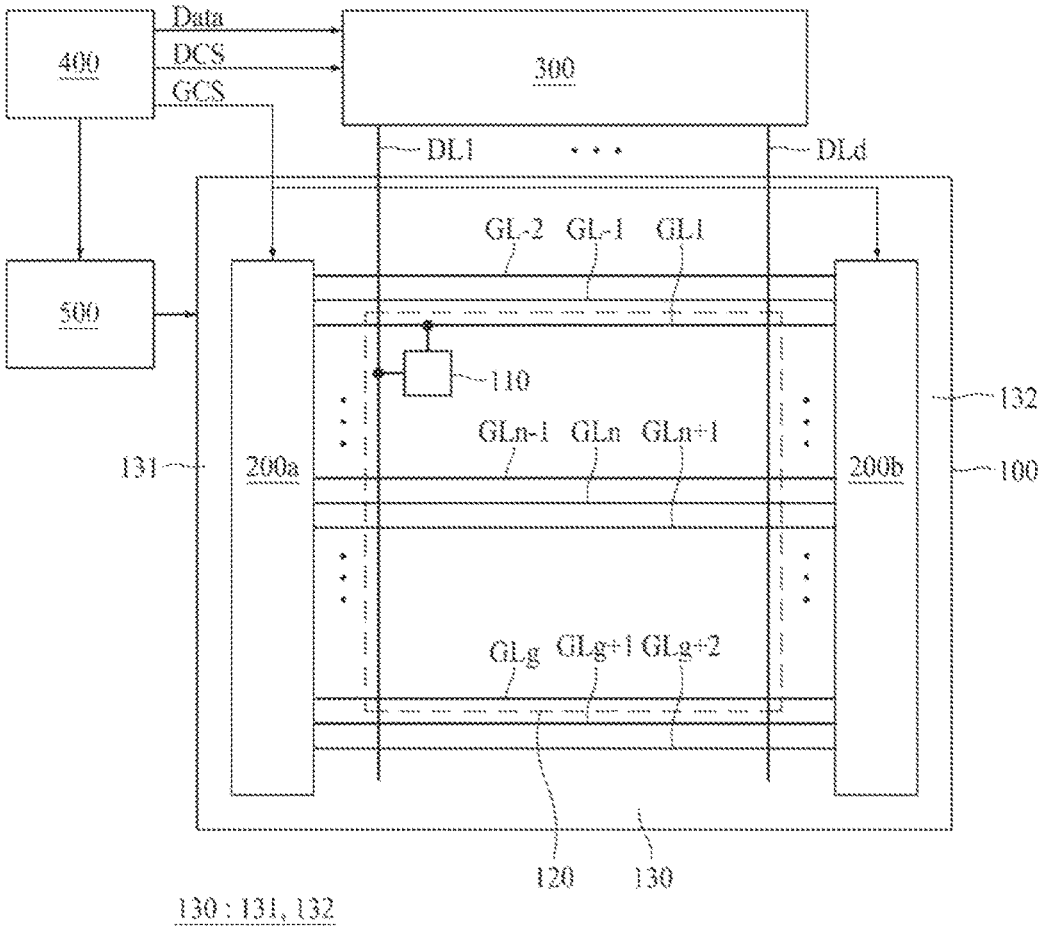
FIG. 1 is a diagram illustrating a configuration of a display device according to an embodiment of the present disclosure.

Reference will now be made in detail to the exemplary embodiments of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. When "comprise," "have," and "include" described in the present specification are used, another part can be added unless "only" is used. The terms of a singular form can include plural forms unless referred to the contrary.

In construing an element, the element is construed as including an error or tolerance range although there is no explicit description of such an error or tolerance range.

In describing a position relationship, for example, when a position relation between two parts is described as, for example, "on," "over," "under," and "next," one or more other parts can be disposed between the two parts unless a more limiting term, such as "just" or "direct(ly)" is used.

In describing a time relationship, for example, when the temporal order is described as, for example, "after," "subsequent," "next," and "before," a case that is not continuous can be included unless a more limiting term, such as "just," "immediate(ly)," or "direct(ly)" is used.

It will be understood that, although the terms "first," "second," etc. can be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing elements of the present disclosure, the terms "first," "second," "A," "B," "(a)," "(b)," etc. can be used. These terms are intended to identify the corresponding elements from the other elements, and basis, order, or number of the corresponding elements should not be limited by these terms. The expression that an element is "connected," "coupled," or "adhered" to another element or layer the element or layer can not only be directly connected or adhered to another element or layer, but also be indirectly connected or adhered to another element or layer with one or more intervening elements or layers "disposed," or "interposed" between the elements or layers, unless otherwise specified.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure can be partially or overall coupled to or combined with each other, and can be variously inter-operated with each other and driven technically as those skilled in the art can sufficiently understand. The embodiments of the present disclosure can be carried out independently from each other, or can be carried out together in co-dependent relationship.

Hereinafter, embodiments of the present disclosure will be described in detail with reference to the accompanying drawings. Further, all the components of each display device according to all embodiments of the present disclosure are operatively coupled and configured.

Figure 2A:
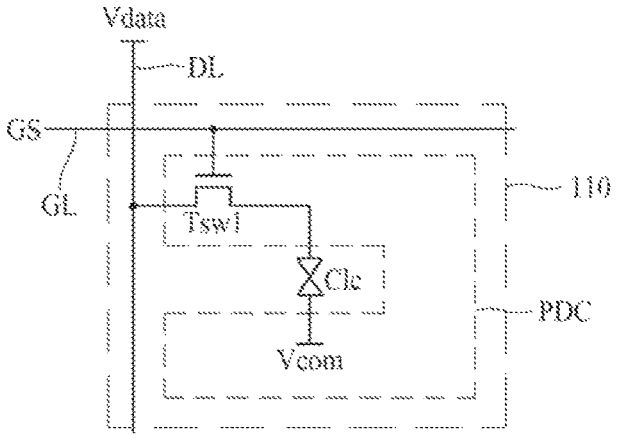
FIGS. 2A and 2B are diagrams illustrating examples of a structure of a pixel applied to the display device according to an embodiment of the present disclosure.
Figure 2B:
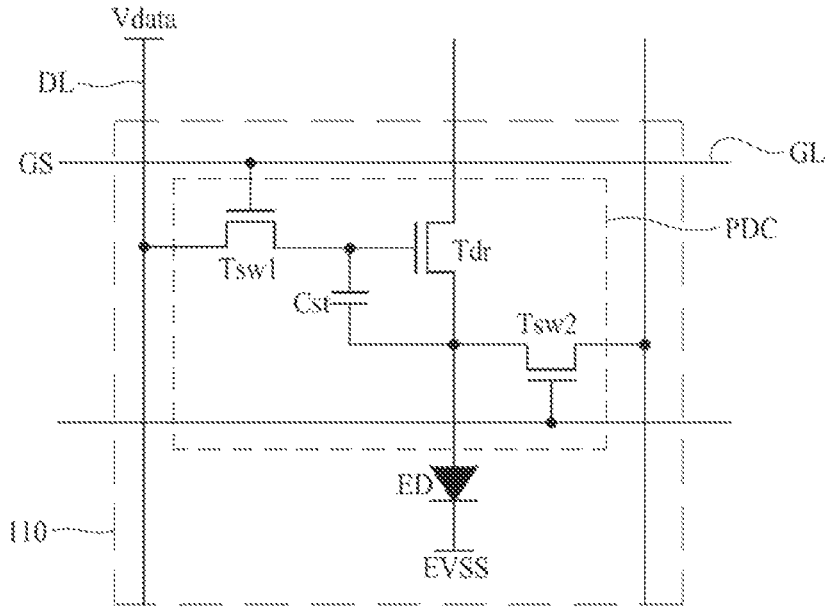
Figure 3:
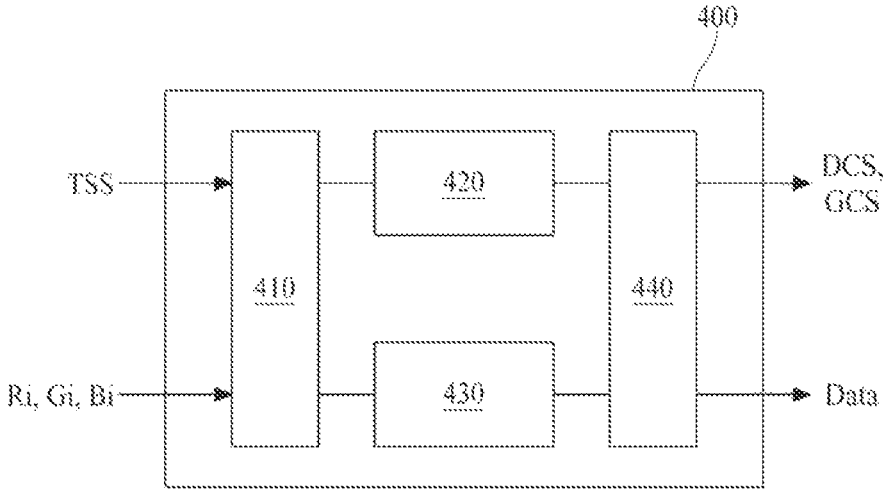
FIG. 3 is a diagram illustrating a structure of a controller applied to the display device according to an embodiment of the present disclosure.

FIG. 1 is a diagram illustrating a configuration of a display device according to an embodiment of the present disclosure. FIGS. 2A and 2B are diagrams illustrating examples of a structure of a pixel applied to a display device according to the present disclosure. FIG. 3 is a diagram illustrating a structure of a controller applied to a display device according to an embodiment of the present disclosure.

The display device according to the present disclosure can configure various electronic devices. The electronic devices can include, for example, smartphones, tablet personal computers (PCs), televisions (TVs), and monitors.

The display device according to the present disclosure, as illustrated in FIG. 1, can include a display panel 100 which includes a display area 120 displaying an image and a non-display area 130 provided outside the display area 120, a plurality of gate drivers 200*a* and 200*b* which supply a gate signal to a plurality of gate lines GL1 to GLg provided in the display area 120 of the display panel 100, a data driver 300 which supplies data voltages to a plurality of data lines DL1 to DLd provided in the display panel 100, a controller 400 which controls driving of the gate drivers 200*a* and 200*b* and the data driver 300, and a power supply 500 which supplies power to the controller 400, the gate drivers 200*a* and 200*b*, the data driver 300, and the display panel 100.

First, the display panel 100 can include the display area 120 and the non-display area 130. The gate lines GL1 to GLg, the data lines DL1 to DLd, and the pixels 110 can be provided in the display area 120. Accordingly, the display area 120 can display an image. Here, g and d can each be a natural number, e.g., positive integer. In particular, g may be an even number. The non-display area 130 can surround the display area 120.

The display panel 100 can be a liquid crystal display panel which includes the pixel 110 illustrated in FIG. 2A, or can be a light emitting display panel which includes the pixel 110 illustrated in FIG. 2B.

For example, when the display panel 100 is the liquid crystal display panel, as illustrated in FIG. 2A, the pixel 110 included in the display panel 100 can include a pixel driving circuit PDC, including a switching transistor Tsw1 and a common electrode, and liquid crystal. The liquid crystal can be included in an emission area. In FIG. 2, Clc can denote liquid crystal which is provided between the common electrode and a pixel electrode connected to the switching transistor Tsw1.

For example, when the display panel 100 is the light emitting display panel, as illustrated in FIG. 2B, the pixel 110 included in the display panel 100 can include a pixel driving circuit PDC, including a switching transistor Tsw1, a storage capacitor Cst, a driving transistor Tdr, and a sensing transistor Tsw2, and an emission area including a light emitting device ED.

A structure of the pixel 110 of the liquid crystal display panel and a structure of the pixel 110 of the light emitting display panel are not limited to a structure illustrated in FIGS. 2A and 2B, and thus, can be implemented as various types.

For example, the display device according to the present disclosure can be an LCD device including the liquid crystal display panel or can be the light emitting display device including the light emitting display panel, but is not limited thereto and can be a display device including various types of display panels.

Hereinafter, for convenience of description, a display device including a light emitting display panel will be described as an example of the present disclosure.

The data driver 300 can be mounted on a chip on film attached on the display panel 100. In this case, the data driver 300 can be connected to the data lines DL1 to DLd included in the display panel 100 and the controller 400 mounted on a main substrate.

The data driver 300 can be directly equipped in the display panel 100, and then, can be connected to the controller 400 provided in the main substrate.

The data driver 300 can be implemented as one integrated circuit (IC) along with the controller 400. In this case, the IC can be mounted on the chip on film, or can be directly equipped in the display panel 100.

The controller 400 can realign input video data Ri, Gi, and Bi transferred from an external system by using a timing synchronization signal TSS transferred from the external system and can generate data control signals DCS which are to be supplied to the data driver 300 and gate control signals GCS which are to be supplied to the gate drivers 200*a* and 200*b*.

To this end, as illustrated in FIG. 3, the controller 400 can include a data aligner 430 which realigns the input video data Ri, Gi, and Bi to generate image data Data and supplies the image data Data to the data driver 300, a control signal generator 420 which generates the gate control signal GCS and the data control signal DCS by using the timing synchronization signal TSS, an input unit 410 which receives the timing synchronization signal TSS and the input video data Ri, Gi, and Bi transferred from the external system and respectively transfers the timing synchronization signal TSS and the input video data Ri, Gi, and Bi to the data aligner 430 and the control signal generator 420, and an output unit 440 which supplies the data driver 300 with the image data Data generated by the data aligner 430 and the data control signal DCS generated by the control signal generator 420 and supplies the gate drivers 200*a* and 200*b* with the gate control signals GCS generated by the control signal generator 420.

The external system can perform a function of driving the controller 400 and an electronic device. For example, when the electronic device is a TV, the external system can receive various sound information, video information, and letter information over a communication network and can transfer the received video information to the controller 400. In this case, the image information can include input video data Ri, Gi, and Bi.

The power supply 500 can generate various powers and can supply the generated powers to the controller 400, the gate drivers 200*a* and 200*b*, the data driver 300, and the display panel 100.

Finally, the gate driver 200 can be implemented as an IC and can be provided in the non-display area 130. Alternatively, the gate driver 200 can be directly embedded in the non-display area 130 by using a gate in panel (GIP) type. When the GIP type is used, transistors configuring the gate driver 200 can be provided in the non-display area through the same process as transistors included in each pixel 110.

When the gate pulse generated by each of the gate drivers 200*a* and 200*b* is supplied to a gate of the switching transistor Tsw1 included in the pixel 110, the switching transistor Tsw1 can be turned on. When the switching transistor Tsw1 is turned on, a data voltage supplied through a data line DL can be supplied to the pixel 110. When a gate off signal generated by each of the gate drivers 200*a* and 200*b* is supplied to the switching transistor Tsw1, the switching transistor Tsw1 can be turned off. When the switching transistor Tsw1 is turned off, data voltage Vdata may not be supplied to the pixel 100 any longer. The gate signal GS supplied to the gate line GL can include a gate pulse and a gate off signal.

In the present disclosure, as illustrated in FIG. 1, two gate drivers 200*a* and 200*b* can be provided.

One gate driver 200*a* can be provided in a first non-display area 131, provided at a left side of the gate line GL, of the non-display area 130. In the following description, a gate driver provided in the first non-display area 131 can be simply referred to as a left gate driver 200*a*.

The other gate driver 200*b* can be provided in a second non-display area 132, provided at a right side of the gate line GL, of the non-display area 130. In the following description, a gate driver provided in the second non-display area 132 can be simply referred to as a right gate driver 200*b*.

In this case, the second non-display area 132 can be provided to face the first non-display area 131, but is not limited thereto. For example, positions of the first non-display area 131 and the second non-display area 132 can be variously changed based on a type where a gate line is provided. Further, in the following description, a left side and a right side can denote one side and the other side of a gate line, and thus, are not limited to a left side and a right side used for expressing a point of the compass.

Detailed structures and functions of the left gate driver 200*a* and the right gate driver 200*b* will be described below with reference to FIGS. 4 to 10. In the following description, the gate driver 200 can be used in a case where all of the left gate driver 200*a* and the right gate driver 200*b* are described.

Figure 4:
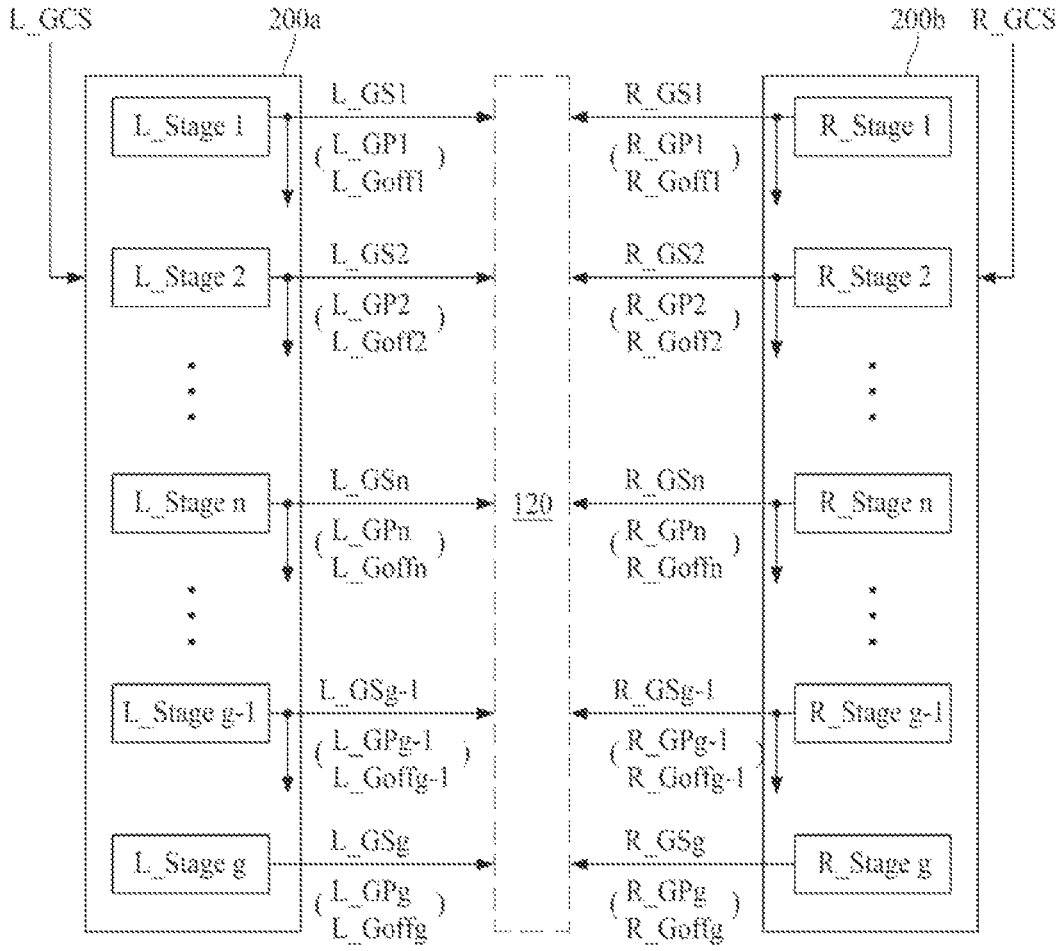
FIG. 4 is a diagram illustrating a structure of each of gate drivers applied to the display device according to an embodiment of the present disclosure.

FIG. 4 is a diagram illustrating a structure of each of gate drivers applied to a display device according to an embodiment of the present disclosure.

In FIG. 4, reference numerals L_GCS and R_GCS can refer to a left gate control signal supplied to the left gate driver 200*a* and a right gate control signal supplied to the right gate driver 200*b*. The left gate control signal L_GCS and the right gate control signal R_GCS can be generated by the control signal generator 420.

As described above, the display panel 100 can include the display area 120 and the non-display area 130 surrounding the display area 120, and the gate lines GL1 to GLg can be included in the display panel 100.

The left gate driver 200*a* can be provided in the first non-display area 131 of the non-display area 130 and can output left gate pulses L_GP1 to L_GPg and left gate off signals L_Goff1 to L_Goffg to the gate lines GL1 to GLg. In FIG. 4, reference numerals L_GS1 to L_GSg can refer to first to $g^{th}$ left gate signals. For example, the first left gate signal L_GS1 can include a first left gate pulse L_GP1 and a first left gate off signal L_Goff1, and the $g^{th}$ left gate signal L_GSg can include a $g^{th}$ left gate pulse L_GPg and a $g^{th}$ left gate off signal L_Goffg.

The right gate driver 200*b* can be provided in the second non-display area 132 of the non-display area 130 and can output right gate pulses R_GP1 to R_GPg and right gate off signals R_Goff1 to R_Goffg to the gate lines GL1 to GLg. In FIG. 4, reference numerals R_GS1 to R_GSg can refer to first to $g^{th}$ right gate signals. For example, the first right gate signal R_GS1 can include a first right gate pulse R_GP1 and a first right gate off signal R_Goff1, and the $g^{th}$ right gate signal R_GSg can include a $g^{th}$ right gate pulse R_GPg and a $g^{th}$ right gate off signal R_Goffg.

At least one gate line can be further provided on the first gate line GL1 in the non-display area 130, and at least one gate line can be further provided on the $g^{th}$ gate line GLg in the non-display area 130. In FIG. 1, the display panel 100 is illustrated where two dummy gate lines GL-1 and GL-2 are provided on the first gate line GL1 and two dummy gate lines GL+1 and GL+2 are provided under the $g^{th}$ gate line GLg.

In this case, the left gate driver 200*a* and the right gate driver 200*b* can output gate pulses and gate off signals to dummy gate lines.

The left gate driver 200*a* can include first to $g^{th}$ left gate stages L_Stage 1 to L_Stage g. Each of the first to $g^{th}$ left gate stages L_Stage 1 to L_Stage g can output at least one gate pulse. In the following description, when all gate pulses should be described, the order of gate pulses is not needed, or it is not required to limit a gate driver which outputs a gate pulse, a gate pulse can be used as simple expression. When a generic name for all stages is needed or the order of gate pulses is not needed, a stage can be used as simple expression. When a generic name for all gate off signals is needed or the order of gate off signals is not needed, a gate off signal can be used as simple expression. Further, in the following description, a stage which outputs an $n^{th}$ left gate pulse L_GPn and an $n^{th}$ left gate off signal L_Goffn can be referred to as an $n^{th}$ left stage L_Stage n. Here, n can be a natural number which is less than or equal to g. For example, n can be a positive integer.

The right gate driver 200*b* can include first to $g^{th}$ right gate stages R_Stage 1 to R_Stage g. Each of the first to $g^{th}$ right gate stages R_Stage 1 to R_Stage g can output at least one gate pulse. In the following description, a stage which outputs an $n^{th}$ right gate pulse R_GPn and an $n^{th}$ right gate off signal R_Goffn can be referred to as an $n^{th}$ right stage R_Stage n.

Hereinafter, the present disclosure will be described with reference to the $n^{th}$ left stage L_Stage n and the $n^{th}$ right stage R_Stage n. The following descriptions of the $n^{th}$ left stage L_Stage n and the $n^{th}$ right stage R_Stage n can be identically applied to the other stages.

Figure 5:
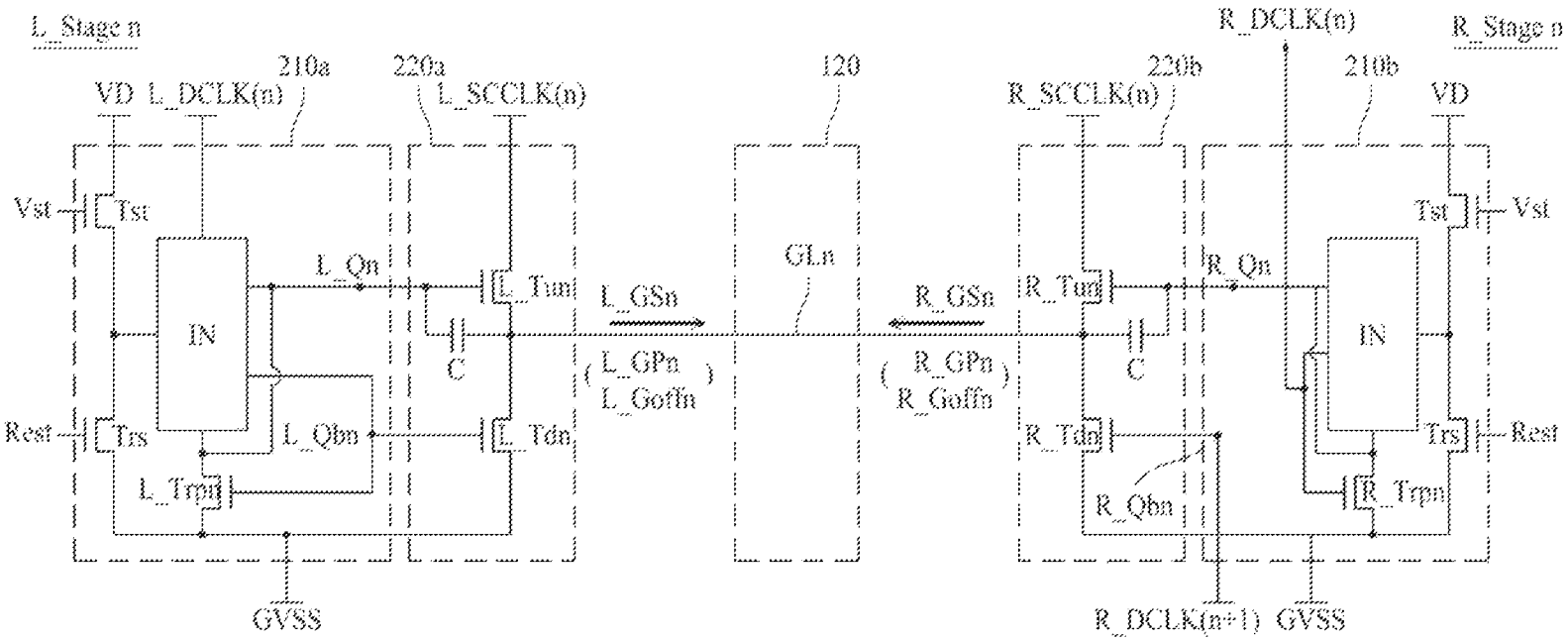
FIG. 5 is a diagram schematically illustrating a structure of each of stages illustrated in FIG. 4.

FIG. 5 is a diagram schematically illustrating a structure of each of the stages illustrated in FIG. 4, and particularly, is a diagram schematically illustrating the $n^{th}$ left stage L_Stage n and the $n^{th}$ right stage R_Stage n.

Each of the stages can include a plurality of transistors, and gate control signals GCS can be supplied to each of the stages. Each of the stages can generate gate pulses by using various kinds of signals and voltages and can sequentially supply the gate pulses to the gate lines GL1 to GLg.

To this end, as illustrated in FIG. 5, the $n^{th}$ left stage L_Stage n can include an $n^{th}$ left signal generator 210*a* which includes an $n^{th}$ left ripple transistor L_Trpn and an $n^{th}$ left signal output unit 220*a* which outputs an $n^{th}$ left gate off signal L_Goffn and an $n^{th}$ left gate pulse L_GPn, based on an $n^{th}$ left control signal generated by the $n^{th}$ left signal generator 210*a*.

The $n^{th}$ right stage R_Stage n can include an $n^{th}$ right signal generator 210*b* which includes an $n^{th}$ right ripple transistor R_Trpn and an $n^{th}$ right signal output unit 220*b* which outputs an $n^{th}$ right gate off signal R_Goffn and an $n^{th}$ right gate pulse R_GPn, based on an $n^{th}$ right control signal generated by the $n^{th}$ right signal generator 210*b*.

In this case, the $n^{th}$ left gate off signal L_Goffn and $n^{th}$ right gate off signal R_Goffn can be alternately output to an $n^{th}$ gate line GLn.

The $n^{th}$ left signal output unit 220*a* can include an $n^{th}$ left pull-up transistor L_Tun which outputs the $n^{th}$ left gate pulse L_GPn and an $n^{th}$ left pull-down transistor L_Tdn which outputs the $n^{th}$ left gate off signal L_Goffn. A capacitor C for stabilizing an output can be provided between an output terminal and a gate of the $n^{th}$ left pull-up transistor L_Tun.

The $n^{th}$ left signal generator 210*a* can generate signals for driving the $n^{th}$ left pull-up transistor L_Tun and the $n^{th}$ left pull-down transistor L_Tdn.

The $n^{th}$ right signal output unit 220*b* can include an $n^{th}$ right pull-up transistor R_Tun which outputs the $n^{th}$ right gate pulse R_GPn and an $n^{th}$ right pull-down transistor R_Tdn which outputs the $n^{th}$ right gate off signal R_Goffn. A capacitor C for stabilizing an output can be provided between an output terminal and a gate of the $n^{th}$ right pull-up transistor R_Tun.

The $n^{th}$ right signal generator 210*b* can generate signals for driving the $n^{th}$ right pull-up transistor R_Tun and the $n^{th}$ right pull-down transistor R_Tdn.

First, the $n^{th}$ left signal generator 210*a* can include a plurality of transistors. In FIG. 5, in order to describe a basic structure and a basic function of the $n^{th}$ left signal generator 210*a* applied to the present disclosure, the $n^{th}$ left signal generator 210*a* including three transistors Tst, Trs, and L_Trpn and an inverter IN is illustrated. For example, an example of the $n^{th}$ left signal generator 210*a* applied to the present disclosure is schematically illustrated in FIG. 5.

A start transistor Tst can be turned on by a start signal Vst and can supply a high voltage VD to the left signal output unit 220*a* through an $n^{th}$ left Q node L_Qn. The high voltage VD passing through the start transistor Tst can be shifted to a voltage, which is lower than the high voltage, by the inverter IN and can be transferred to an $n^{th}$ left Qb node L_Qbn.

When the start transistor Tst is turned on and a reset transistor Trs is turned on by a reset signal Rest, a low voltage GVSS can be supplied to the $n^{th}$ left Qb node L_Qbn through the reset transistor Trs. The low voltage GVSS can be shifted to a voltage, which is higher than the low voltage, by the inverter IN and can be supplied to the $n^{th}$ left Qb node L_Qbn. The inverter IN can be formed in various structures including at least one transistor so as to perform a function described above.

A first terminal of the $n^{th}$ left ripple transistor L_Trpn can be connected to the $n^{th}$ left Q node L_Qn, a second terminal of the $n^{th}$ left ripple transistor L_Trpn can be connected to a first voltage terminal, and a gate of the $n^{th}$ left ripple transistor L_Trpn can be connected to a gate of the $n^{th}$ left pull-down transistor L_Tdn which controls an output of the $n^{th}$ left gate off signal L_Goffn.

Here, the first voltage terminal can be supplied with the low voltage GVSS. For example, the first voltage terminal can be supplied with the low voltage GVSS for turning off the $n^{th}$ left pull-up transistor L_Tun.

A gate of the $n^{th}$ left ripple transistor L_Trpn and a gate of the $n^{th}$ left pull-down transistor L_Tdn can be connected to a terminal which is supplied with an $n^{th}$ left ripple clock L_DCLK(n). Accordingly, the gate of the $n^{th}$ left ripple transistor L_Trpn and the gate of the $n^{th}$ left pull-down transistor L_Tdn can be supplied with the $n^{th}$ left ripple clock L_DCLK(n).

Second, the $n^{th}$ right signal generator 210*b* can include a plurality of transistors. In FIG. 5, in order to describe a basic structure and a basic function of the $n^{th}$ right signal generator

210*b* applied to the present disclosure, the $n^{th}$ right signal generator 210*b* including three transistors Tst, Trs, and L_Trpn and an inverter IN is illustrated. For example, an example of the $n^{th}$ right signal generator 210*b* applied to the present disclosure is schematically illustrated in FIG. 5.

A start transistor Tst can be turned on by the start signal Vst and can supply the high voltage VD to the right signal output unit 220*b* through an $n^{th}$ right Q node R_Qn.

When the start transistor Tst is turned off and a reset transistor Trs is turned on by the reset signal Rest, the low voltage GVSS can be supplied to the $n^{th}$ right Q node R_Qn through the reset transistor Trs. The inverter IN can be formed in various structures including at least one transistor.

A first terminal of the $n^{th}$ right ripple transistor R_Trpn can be connected to the $n^{th}$ right Q node R_Qn, a second terminal of the $n^{th}$ right ripple transistor R_Trpn can be connected to the first voltage terminal, and a gate of the $n^{th}$ right ripple transistor R_Trpn can be connected to a terminal which is supplied with an $n^{th}$ right ripple clock R_DCLK(n).

Therefore, the $n^{th}$ right ripple clock R_DCLK(n) can be supplied to the gate of the $n^{th}$ right ripple transistor R_Trpn.

As described above, the gate of the $n^{th}$ left ripple transistor L_Trpn can be connected to a gate of the $n^{th}$ left pull-down transistor L_Tdn which controls an output of the $n^{th}$ left gate off signal L_Goffn.

However, the gate of the $n^{th}$ right ripple transistor R_Trpn may not be connected to the gate of the $n^{th}$ right pull-down transistor R_Tdn which controls an output of the $n^{th}$ right gate off signal R_Goffn. The gate of the $n^{th}$ right pull-down transistor R_Tdn can be connected to a gate of an $n+1^{th}$ right ripple transistor included in a stage (for example, an $n+1^{th}$ right stage) next to an $n^{th}$ right stage R_Stage n. In this case, the gate of the $n^{th}$ right ripple transistor R_Trpn can be connected to a gate of an $n-1^{th}$ right pull-down transistor included in a previous stage (for example, an $n-1^{th}$ right stage) with respect to the $n^{th}$ right stage R_Stage n.

To provide an additional description, outputs of the $n^{th}$ left gate off signal L_Goffn and the $n^{th}$ right gate off signal R_Goffn can be controlled by Qb nodes included in the $n^{th}$ left stage L_Stage n and the $n^{th}$ right stage R_Stage n. In this case, a gate of an $n^{th}$ left ripple transistor L_Trpn and an $n^{th}$ left Qb node L_Qbn included in the $n^{th}$ left stage L_Stage n can be connected to each other, and an $n^{th}$ right Qb node R_Qbn included in the $n^{th}$ right stage R_Stage n can be connected to a gate of an $n+1^{th}$ right ripple transistor included in an $n+1^{th}$ right stage.

Third, the $n^{th}$ left signal output unit 220*a* can include an $n^{th}$ left pull-up transistor L_Tun which outputs an $n^{th}$ left gate pulse L_GPn, and a gate of the $n^{th}$ left pull-up transistor L_Tun can be connected to an $n^{th}$ left Q node L_Qn.

The $n^{th}$ left signal output unit 220*a* can include an $n^{th}$ left pull-down transistor L_Tdn which outputs an $n^{th}$ left gate off signal L_Goffn, and a gate of the $n^{th}$ left pull-down transistor L_Tdn can be connected to a gate of an $n^{th}$ left ripple transistor L_Trpn.

Fourth, the $n^{th}$ right signal output unit 220*b* can include an $n^{th}$ right pull-up transistor R_Tun which outputs an $n^{th}$ right gate pulse R_GPn, and a gate of the $n^{th}$ right pull-up transistor R_Tun can be connected to an $n^{th}$ right Q node R_Qn.

The $n^{th}$ right signal output unit 220*b* can include an $n^{th}$ right pull-down transistor R_Tdn which outputs an $n^{th}$ right gate off signal R_Goffn, and a gate of the $n^{th}$ right pull-down transistor R_Tdn can be connected to a gate of an $n+1^{th}$ right ripple transistor included in a stage (for example, an $n+1^{th}$ right stage) next to the $n^{th}$ right stage R_Stage n.

Figure 6:
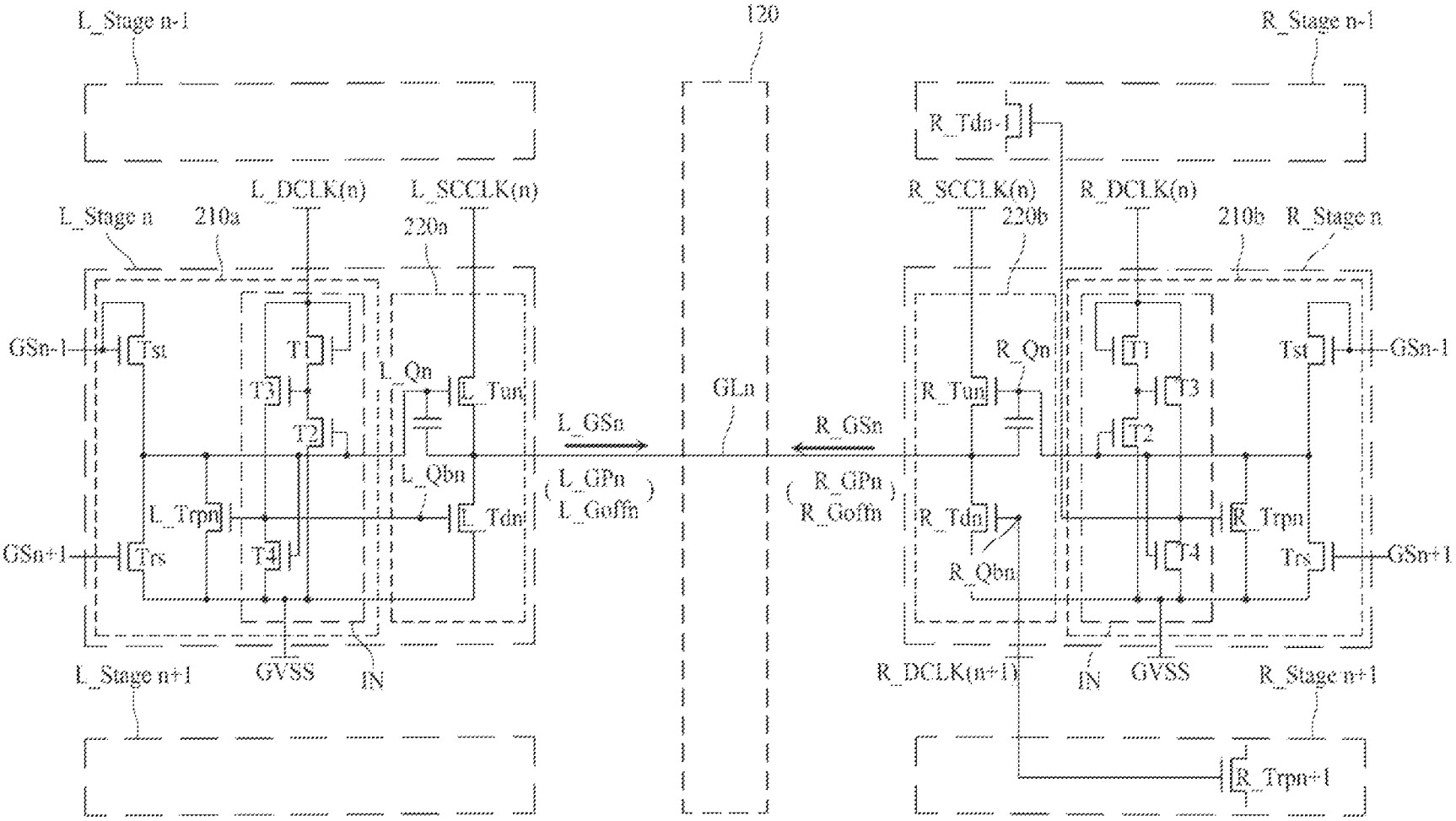
FIG. 6 is a diagram illustrating in detail a structure of each of the stages illustrated in FIG. 4.

FIG. 6 is a diagram illustrating in detail a structure of each of the stages illustrated in FIG. 4. A basic structure of each of $n-1^{th}$ to $n+1^{th}$ left stages L_Stage n−1 to L_Stage n+1 and $n-1^{th}$ to $n+1^{th}$ right stages R_Stage n−1 to R_Stage n+1 can be the same as a basic structure of each of the $n^{th}$ left stage L_Stage n and the $n^{th}$ right stage R_Stage n described above with reference to FIG. 5. Hereinafter, therefore, descriptions which are the same as or similar to descriptions given above with reference to FIG. 5 are omitted or will be briefly given.

First, the $n-1^{th}$ to $n+1^{th}$ left stages L_Stage n−1 to L_Stage n+1 illustrated in FIG. 6 can be implemented as the same type. Hereinafter, therefore, a structure of the $n^{th}$ left stage L_Stage n will be described. Comparing with the $n^{th}$ left stage illustrated in FIG. 5, in the $n^{th}$ left stage L_Stage n illustrated in FIG. 6, a structure of an inverter IN is illustrated in detail.

For example, the inverter IN of the $n^{th}$ left stage L_Stage n illustrated in FIG. 6 can include first to fourth transistors T1 to T4.

A first terminal and a gate of the first transistor T1 can be connected to a terminal to which an $n^{th}$ left ripple clock L_DCLK(n) is input, and a second terminal thereof can be connected to a first terminal of the second transistor T2.

The first terminal of the second transistor T2 can be connected to the second terminal of the first transistor T1, a gate thereof can be connected to an $n^{th}$ left Q node L_Qn, and a second terminal thereof can be connected to a terminal which is supplied with the low voltage GVSS.

A first terminal of the third transistor T3 can be connected to the terminal to which the $n^{th}$ left ripple clock L_DCLK(n) is input, a second terminal thereof can be connected to a first terminal of the fourth transistor T4, and a gate thereof can be connected to the second terminal of the first transistor T1 and the first terminal of the second transistor T2.

The first terminal of the fourth transistor T4 can be connected to the second terminal of the third transistor T3, a gate thereof can be connected to the $n^{th}$ left Q node L_Qn, and a second terminal thereof can be connected to the terminal which is supplied with the low voltage GVSS.

The inverter IN of the $n^{th}$ left stage L_Stage n can be implemented as various types, in addition to a structure described above.

A first terminal and a gate of a start transistor Tst of the $n^{th}$ left stage L_Stage n can be supplied with an $n-1^{th}$ left gate signal L_GS(n−1) output from a previous stage (for example, the $n-1^{th}$ left stage L_Stage n−1).

An $n+1^{th}$ left gate signal L_GS(n+1) output from a next stage (for example, the $n+1^{th}$ left stage L_Stage n+1) can be input to a gate of a reset transistor Trs of the $n^{th}$ left stage L_Stage n.

A structure and a feature of each of the other elements of the $n^{th}$ left stage L_Stage n, except differences described above, can be the same as a structure and a feature of the $n^{th}$ left stage described above with reference to FIG. 5, and thus, detailed descriptions thereof are omitted.

Second, the $n-1^{th}$ to $n+1^{th}$ right stages R_Stage n−1 to R_Stage n+1 illustrated in FIG. 6 can be implemented as the same type. Hereinafter, therefore, a structure of the $n^{th}$ right stage R_Stage n will be described. Comparing with the $n^{th}$ right stage illustrated in FIG. 5, in the $n^{th}$ right stage R_Stage n illustrated in FIG. 6, a structure of an inverter IN is illustrated in detail.

For example, the inverter IN of the $n^{th}$ right stage R_Stage n illustrated in FIG. 6 can include first to fourth transistors T1 to T4.

A first terminal and a gate of the first transistor T1 can be connected to a terminal to which an $n^{th}$ right ripple clock R_DCLK(n) is input, and a second terminal thereof can be connected to a first terminal of the second transistor T2.

The first terminal of the second transistor T2 can be connected to the second terminal of the first transistor T1, a gate thereof can be connected to an $n^{th}$ right Q node R_Qn, and a second terminal thereof can be connected to a terminal which is supplied with the low voltage GVSS.

A first terminal of the third transistor T3 can be connected to the terminal to which the $n^{th}$ right ripple clock R_DCLK(n) is input, a second terminal thereof can be connected to a first terminal of the fourth transistor T4, and a gate thereof can be connected to the second terminal of the first transistor T1 and the first terminal of the second transistor T2.

The first terminal of the fourth transistor T4 can be connected to the second terminal of the third transistor T3, a gate thereof can be connected to the $n^{th}$ right Q node R_Qn, and a second terminal thereof can be connected to the terminal which is supplied with the low voltage GVSS.

The inverter IN of the $n^{th}$ right stage R_Stage n can be implemented as various types, in addition to a structure described above.

In this case, an arrangement structure of the first to fourth transistors T1 to T4 included in the inverter IN of the $n^{th}$ right stage R_Stage n can be the same as an arrangement structure of the first to fourth transistors T1 to T4 included in the inverter IN of the $n^{th}$ left stage L_Stage n.

A first terminal and a gate of a start transistor Tst of the $n^{th}$ right stage R_Stage n can be supplied with an $n-1^{th}$ right gate signal R_GS(n−1) output from a previous stage (for example, the $n-1^{th}$ right stage R_Stage n−1).

An $n+1^{th}$ right gate signal R_GS(n+1) output from a next stage (for example, the $n+1^{th}$ right stage R_Stage n+1) can be input to a gate of a reset transistor Trs of the $n^{th}$ right stage R_Stage n.

A structure and a feature of each of the other elements of the $n^{th}$ right stage R_Stage n, except differences described above, can be the same as a structure and a feature of the $n^{th}$ right stage described above with reference to FIG. 5, and thus, detailed descriptions thereof are omitted.

Hereinafter, a driving method of a display device according to an embodiment of the present disclosure will be described with reference to FIGS. 1 to 8.

Figure 7:
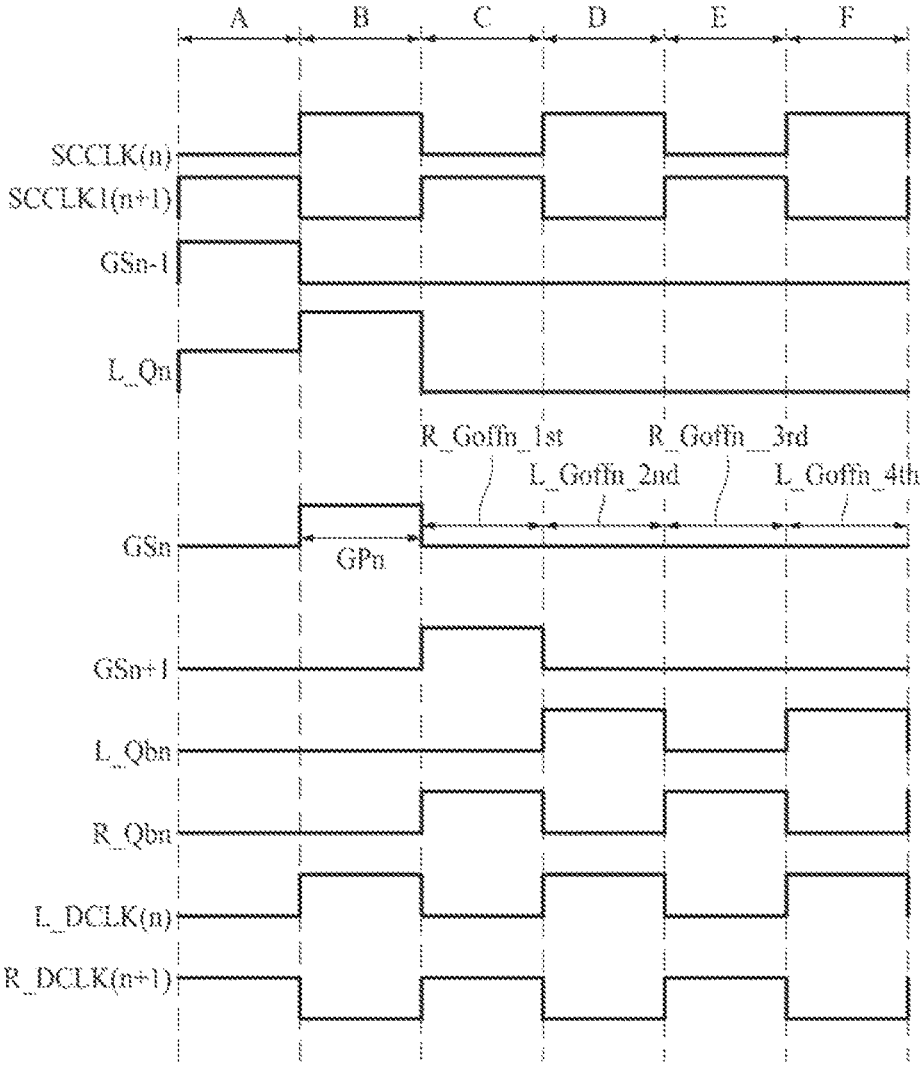
FIG. 7 is a diagram showing waveforms applied to a display device according to an embodiment of the present disclosure.
Figure 8:
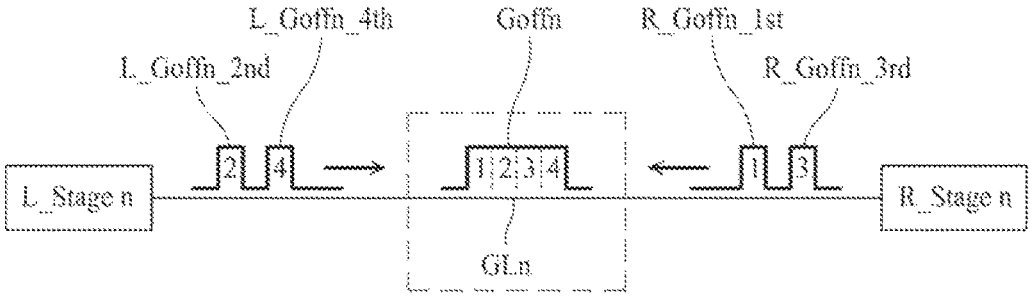
FIG. 8 is a diagram illustrating a method of outputting a gate off signal in a display device according to an embodiment of the present disclosure.

FIG. 7 is a diagram showing waveforms applied to a display device according to an embodiment of the present disclosure, and FIG. 8 is a diagram illustrating a method of outputting a gate off signal in a display device according to an embodiment of the present disclosure. Hereinafter, the present disclosure will be described with reference to an $n^{th}$ left stage L_Stage n and an $n^{th}$ right stage R_Stage n. In the following description, descriptions which are the same as or similar to descriptions given above with reference to FIGS. 1 to 6 are omitted or will be briefly given.

First, in a first process A, an $n-1^{th}$ gate signal GSn−1 having a high level can be input as a start signal of each of the $n^{th}$ left stage L_Stage n and the $n^{th}$ right stage R_Stage n.

Therefore, an $n^{th}$ left Q node L_Qn and an $n^{th}$ right Q node R_Qn can be charged.

In a second process B, an $n^{th}$ left gate clock L_SCCLK(n) and an $n^{th}$ right gate clock R_SCCLK(n) can have a high level. For example, a phase of the $n^{th}$ left gate clock L_SCCLK(n) can be the same as that of the $n^{th}$ right gate clock R_SCCLK(n). Therefore, in FIG. 7, the $n^{th}$ left gate clock L_SCCLK(n) and the $n^{th}$ right gate clock R_SCCLK(n) are illustrated as an $n^{th}$ gate clock SCCLK(n). In the following description, when it is not required to differentiate the $n^{th}$ left gate clock L_SCCLK(n) from the $n^{th}$ right gate clock R_SCCLK(n), the $n^{th}$ gate clock SCCLK(n) can be used.

Therefore, a level of the $n^{th}$ left Q node L_Qn and the $n^{th}$ left gate clock L_SCCLK(n) can be boosted, and thus, the $n^{th}$ left pull-up transistor L_Tun can be turned on.

Accordingly, an $n^{th}$ gate pulse GPn can be output to the $n^{th}$ gate line GLn through the $n^{th}$ left pull-up transistor L_Tun.

In this case, the $n^{th}$ gate pulse GPn can be output from the $n^{th}$ right stage R_Stage n, based on the same method.

Subsequently, in a third process C, an $n+1^{th}$ gate signal GSn+1 having a high level can be input as a reset signal of each of the $n^{th}$ left stage L_Stage n and the $n^{th}$ right stage R_Stage n. Accordingly, the $n^{th}$ left pull-up transistor L_Tun can be turned off. In this case, the $n^{th}$ right pull-up transistor R_Tun can also be turned off.

Subsequently, in the third process C, an $n+1^{th}$ right ripple clock R_DCLK(n+1) having a high level can be input from an $n+1^{th}$ right stage R_Stage n+1 to an $n^{th}$ right Qb node R_Qbn.

Accordingly, an $n_1^{th}$ right gate off signal R_Goffn_1st can be output from the $n^{th}$ right stage R_Stage n to the $n^{th}$ gate line GLn. The $n_1^{th}$ right gate off signal R_Goffn_1st can configure an $n^{th}$ right gate off signal R_Goffn.

In this case, because the $n^{th}$ left ripple clock L_DCLK(n) having a low level is input to the $n^{th}$ right stage R_Stage n, a gate off signal may not be output from the $n^{th}$ right stage R_Stage n.

Subsequently, in a fourth process D, the $n^{th}$ left ripple clock L_DCLK(n) having a high level can be input to an $n^{th}$ left Qb node L_Qbn.

Accordingly, an $n_2^{th}$ left gate off signal L_Goffn_2nd can be output from the $n^{th}$ left stage L_Stage n to the $n^{th}$ gate line GLn. The $n_2^{th}$ left gate off signal L_Goffn_2nd can configure an $n^{th}$ left gate off signal L_Goffn.

In this case, a low level can be continuously supplied to an $n^{th}$ left Q node L_Qn.

However, the $n^{th}$ left gate clock L_SCCLK(n) having a high level can be input to the first terminal of the $n^{th}$ left pull-up transistor L_Tun. Accordingly, ripple can occur in the $n^{th}$ left Q node due to the $n^{th}$ left gate clock L_SCCLK(n) having a high level.

In this case, because the $n^{th}$ left ripple clock L_DCLK(n) having a high level is supplied to the $n^{th}$ left Qb node L_Qbn, the $n^{th}$ left ripple transistor L_Trpn can be turned on. Accordingly, ripple occurring in the $n^{th}$ left Q node L_Qn can be discharged to a terminal, which is supplied with the low voltage GVSS, through the $n^{th}$ left ripple transistor L_Trpn.

In this case, the $n^{th}$ right ripple transistor R_Trpn can be driven based on the same method as the $n^{th}$ left ripple transistor L_Trpn. Accordingly, ripple occurring in the $n^{th}$ right Q node R_Qn can be discharged to a terminal, which is supplied with the low voltage GVSS, through the $n^{th}$ right ripple transistor R_Trpn.

For example, because a phase of the $n^{th}$ left ripple clock L_DCLK(n) is the same as that of the $n^{th}$ right ripple clock R_DCLK(n) and the phase of the $n^{th}$ left gate clock L_SCCLK(n) is the same as that of the $n^{th}$ right gate clock R_SCCLK(n), as described above, the same operation can be performed by the nth left stage L_Stage n and the nth right stage R_Stage n.

Subsequently, in a fifth process E, the $n+1^{th}$ right ripple clock R_DCLK(n+1) having a high level can be input from the $n+1^{th}$ right stage R_Stage n+1 to the $n^{th}$ right Qb node R_Qbn.

Therefore, an n_3$^{th}$ right gate off signal R_Goffn_3rd can be output from the n$^{th}$ right stage R_Stage n to the n$^{th}$ gate line GLn. The n_3$^{th}$ right gate off signal R_Goffn_3rd can configure the n$^{th}$ right gate off signal R_Goffn.

Finally, in a sixth process F, the n$^{th}$ left ripple clock L_DCLK(n) having a high level can be input to the n$^{th}$ left Qb node L_Qbn.

Therefore, an n_4$^{th}$ left gate off signal L_Goffn_4th can be output from the n$^{th}$ left stage L_Stage n to the n$^{th}$ gate line GLn. The n_4$^{th}$ left gate off signal L_Goffn_4th can configure the n$^{th}$ left gate off signal L_Goffn.

In this case, a low level can be supplied to the n$^{th}$ left Q node L_Qn. However, the n$^{th}$ left gate clock L_SCCLK(n) having a high level can be input to a first terminal of the n$^{th}$ left pull-up transistor L_Tun. Accordingly, ripple can occur in the n$^{th}$ left Q node due to the n$^{th}$ left gate clock L_SCCLK(n) having a high level.

In this case, because the n$^{th}$ left ripple clock L_DCLK(n) having a high level is supplied to the n$^{th}$ left Qb node L_Qbn, the n$^{th}$ left ripple transistor L_Trpn can be turned on. Therefore, ripple occurring in the n$^{th}$ left Q node L_Qn can be discharged to a terminal, which is supplied with the low voltage GVSS, through the n$^{th}$ left ripple transistor L_Trpn.

In this case, the n$^{th}$ right ripple transistor R_Trpn can be driven based on the same method as the n$^{th}$ left ripple transistor L_Trpn. Accordingly, ripple occurring in the n$^{th}$ right Q node R_Qn can be discharged to a terminal, which is supplied with the low voltage GVSS, through the n$^{th}$ right ripple transistor R_Trpn.

The third to sixth processes C to F can be repeated until another n$^{th}$ gate pulse is output from the n$^{th}$ left stage L_Stage n and the n$^{th}$ right stage R_Stage n, and thus, the n$^{th}$ gate off signal can be continuously output to the n$^{th}$ gate line GLn.

For example, through the processes described above, n$^{th}$ gate pulses GPn can be output from the n$^{th}$ left stage L_Stage n and the n$^{th}$ right stage R_Stage n to the nth gate line GLn.

Moreover, as illustrated in FIG. 8, the n_1$^{th}$ right gate off signal R_Goffn_1st and the n_3$^{th}$ right gate off signal R_Goffn_3rd can be output from the n$^{th}$ right stage R_Stage n to the n$^{th}$ gate line GLn, and the n_2$^{th}$ left gate off signal L_Goffn_2nd and the n_4$^{th}$ left gate off signal L_Goffn_4th can be output from the n$^{th}$ left stage L_Stage n to the n$^{th}$ gate line GLn.

In this case, the n_1$^{th}$ right gate off signal R_Goffn_1st, the n_3$^{th}$ right gate off signal R_Goffn_3rd, the n_2$^{th}$ left gate off signal L_Goffn_2nd, and the n_4$^{th}$ left gate off signal L_Goffn_4th can configure the n$^{th}$ gate off signal Goffn supplied to the n$^{th}$ gate line GLn.

In this case, in FIG. 8, for convenience of description, the n_1$^{th}$ right gate off signal R_Goffn_1st, the n_3$^{th}$ right gate off signal R_Goffn_3rd, the n_2$^{th}$ left gate off signal L_Goffn_2nd, and the n_4$^{th}$ left gate off signal L_Goffn_4th are shown in a high-level pulse form. However, in the embodiment described above, the n_1$^{th}$ right gate off signal R_Goffn_1st, the n_3$^{th}$ right gate off signal R_Goffn_3rd, the n_2$^{th}$ left gate off signal L_Goffn_2nd, and the n_4$^{th}$ left gate off signal L_Goffn_4th can be substantially continuous signals having a low level.

For example, the n$^{th}$ left stage L_Stage n and the n$^{th}$ right stage R_Stage n can sequentially output the n$^{th}$ gate off signal Goffn to the n$^{th}$ gate line GLn. Accordingly, the n$^{th}$ gate off signal Goffn can be continuously output to the n$^{th}$ gate line GLn.

In the present disclosure, outputs of the n$^{th}$ left gate pulse L_GPn and the n$^{th}$ right gate pulse R_GPn can be controlled by the Q nodes included in the n$^{th}$ left stage L_Stage n and the n$^{th}$ right stage R_Stage n.

In this case, the n$^{th}$ left ripple transistor L_Trpn which is provided in the n$^{th}$ left stage L_Stage n to remove ripple occurring in the n$^{th}$ left Q node L_Qn of the n$^{th}$ left stage L_Stage n and the n$^{th}$ right ripple transistor R_Trpn which is provided in the n$^{th}$ right stage R_Stage n to remove ripple occurring in the n$^{th}$ right Q node R_Qn of the n$^{th}$ right stage R_Stage n can simultaneously and continuously perform an on operation and an off operation.

Because each of the n$^{th}$ left ripple transistor L_Trpn and the n$^{th}$ right ripple transistor R_Trpn repeats a turn-on operation and a turn-off operation, the n$^{th}$ left ripple transistor L_Trpn and the n$^{th}$ right ripple transistor R_Trpn may not be degraded, and a speed at which the n$^{th}$ left ripple transistor L_Trpn and the n$^{th}$ right ripple transistor R_Trpn are degraded can be reduced. Accordingly, the reliability of the display device according to the present disclosure including the n$^{th}$ left ripple transistor L_Trpn and the n$^{th}$ right ripple transistor R_Trpn can be enhanced.

Hereinafter, features of the present disclosure will be described.

First, in the present disclosure, a phase of the n$^{th}$ left gate clock L_SCCLK(n) supplied to the n$^{th}$ left stage L_Stage n to generate the n$^{th}$ left gate pulse L_GPn can be the same as that of the n$^{th}$ left ripple clock L_DCLK(n) supplied for driving the n$^{th}$ left ripple transistor L_Trpn, and a phase of the n$^{th}$ right gate clock R_SCCLK(n) supplied to the n$^{th}$ right stage R_Stage n to generate the n$^{th}$ right gate pulse R_GPn can be the same as that of the n$^{th}$ right ripple clock R_DCLK(n) supplied for driving the n$^{th}$ right ripple transistor R_Trpn.

For example, the n$^{th}$ left ripple transistor L_Trpn can be turned on by the n$^{th}$ left gate clock L_SCCLK(n) having a high level only when ripple occurs in the n$^{th}$ left Q node L_Qn, and the n$^{th}$ right ripple transistor R_Trpn can be turned on by the n$^{th}$ right gate clock R_SCCLK(n) having a high level only when ripple occurs in the n$^{th}$ right Q node R_Qn. Accordingly, as described above, a speed at which the n$^{th}$ left ripple transistor L_Trpn and the n$^{th}$ right ripple transistor R_Trpn are degraded can be reduced.

Second, a phase of the n$^{th}$ left ripple clock L_DCLK(n) supplied for driving the n$^{th}$ left ripple transistor L_Trpn can be the same as that of the n$^{th}$ right ripple clock R_DCLK(n) supplied for driving the n$^{th}$ right ripple transistor R_Trpn.

For example, the n$^{th}$ left ripple clock L_DCLK(n) can be supplied to a gate of the n$^{th}$ left ripple transistor L_Trpn, the n$^{th}$ right ripple clock R_DCLK(n) can be supplied to a gate of the n$^{th}$ right ripple transistor R_Trpn, and a phase of the n$^{th}$ left ripple clock L_DCLK(n) can be the same as that of the n$^{th}$ right ripple transistor R_Trpn.

Therefore, the n$^{th}$ left ripple transistor L_Trpn and the n$^{th}$ right ripple transistor R_Trpn can simultaneously perform an on operation and an off operation.

Third, when the n$^{th}$ left ripple transistor L_Trpn is turned on, the n$^{th}$ left gate off signal L_Goffn can be output from the n$^{th}$ left stage L_Stage n to the n$^{th}$ gate line GLn, and when the n$^{th}$ left ripple transistor L_Trpn and the n$^{th}$ right ripple transistor R_Trpn are turned off, the n$^{th}$ right gate off signal R_Goffn can be output from the n$^{th}$ right stage R_Stage n to the n$^{th}$ gate line GLn.

For example, the n$^{th}$ left gate off signal L_Goffn output from the n$^{th}$ left stage L_Stage n and the n$^{th}$ right gate off signal R_Goffn output from the n$^{th}$ right stage R_Stage n can be alternately output to the n$^{th}$ gate line GLn.

To provide an additional description, in the present disclosure, because a gate off signal is alternately output from two stages which are provided at both sides of a gate line, the gate off signal can be continuously supplied to the gate line. Therefore, the gate line may not be floated, and thus, switching transistors connected to the gate line may not be abnormally driven. Accordingly, the reliability of a display device can be enhanced.

Figure 9:
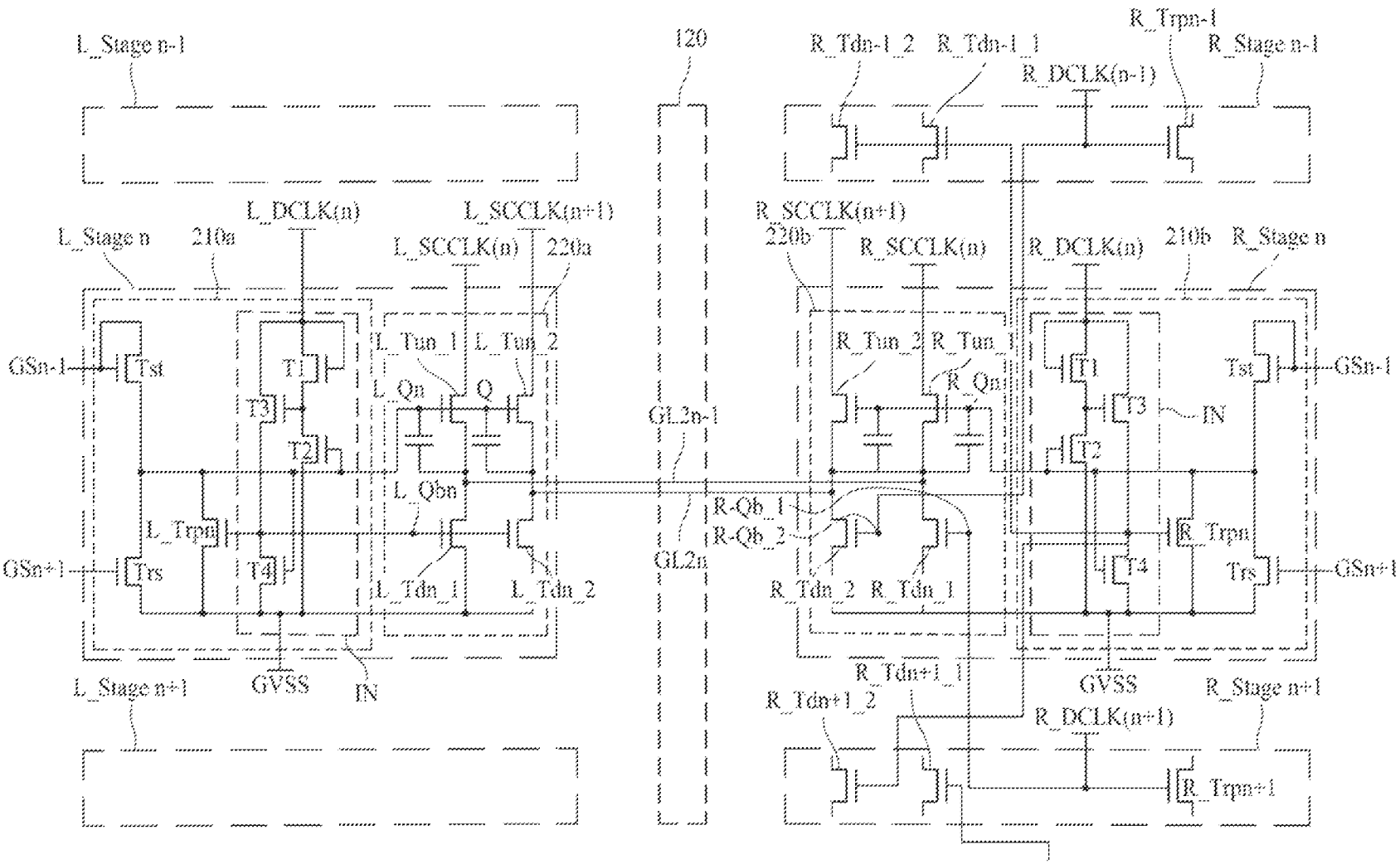
FIG. 9 is another diagram illustrating in detail a structure of each of the stages illustrated in FIG. 4.

FIG. 9 is another diagram illustrating in detail a structure of each of the stages illustrated in FIG. 4. A basic structure of each of $n-1^{th}$ to $n+1^{th}$ left stages L_Stage n−1 to L_Stage n+1 and $n-1^{th}$ to $n+1^{th}$ right stages R_Stage n−1 to R_Stage n+1 illustrated in FIG. 9 can be the same as a basic structure of each of the $n^{th}$ left stage L_Stage n and the $n^{th}$ right stage R_Stage n described above with reference to FIG. 5. Hereinafter, therefore, descriptions which are the same as or similar to descriptions given above with reference to FIGS. 5 and 6 are omitted or will be briefly given, and particularly, features of stages illustrated in FIG. 9 will be briefly described. In FIG. 9, n can be a natural number which is less than or equal to g/2 and can be an even number.

First, a structure of an $n^{th}$ left signal generator 210*a* of the $n^{th}$ left stage L_Stage n illustrated in FIG. 9 can be the same as that of the $n^{th}$ left signal generator 210*a* of the $n^{th}$ left stage L_Stage n illustrated in FIG. 6.

Second, the $n^{th}$ left signal output unit 220*a* illustrated in FIG. 6 can include only the $n^{th}$ left pull-up transistor L_Tun.

However, an $n^{th}$ left signal output unit 220*a* illustrated in FIG. 9 can include an $n^{th}$ left pull-up transistor L_Tun and an $n_2^{th}$ left pull-up transistor L_Tun_2.

In describing the $n^{th}$ left signal output unit 220*a* illustrated in FIG. 9, the $n^{th}$ left pull-up transistor L_Tun can be referred to as an $n_1^{th}$ left pull-up transistor L_Tun_1. For example, a gate of the $n_1^{th}$ left pull-up transistor L_Tun_1 illustrated in FIG. 9 can be connected to an $n^{th}$ left Q node.

A gate of the $n_2^{th}$ left pull-up transistor L_Tun_2 can also be connected to the $n^{th}$ left Q node.

Third, the $n^{th}$ left signal output unit 220*a* illustrated in FIG. 6 can include only the $n^{th}$ left pull-down transistor L_Tdn.

However, the $n^{th}$ left signal output unit 220*a* illustrated in FIG. 9 can include an $n^{th}$ left pull-down transistor L_Tdn and an $n_2^{th}$ left pull-down transistor L_Tdn_2. The $n_2^{th}$ left pull-down transistor L_Tdn_2 can be connected to the $n^{th}$ left pull-up transistor L_Tun.

In describing the $n^{th}$ left signal output unit 220*a* illustrated in FIG. 9, the $n^{th}$ left pull-down transistor L_Tdn can be referred to as an $n_1^{th}$ left pull-down transistor L_Tdn_1. For example, a gate of the $n_1^{th}$ left pull-down transistor L_Tdn_1 illustrated in FIG. 9 can be connected to an $n^{th}$ left Qb node L_Qbn.

A gate of the $n_2^{th}$ left pull-down transistor L_Tdn_2 can also be connected to the $n^{th}$ left Qb node L_Qbn. Therefore, the gate of the $n_2^{th}$ left pull-down transistor L_Tdn_2 can also be connected to a gate of an $n^{th}$ left ripple transistor L_Trpn.

Fourth, a structure of an $n^{th}$ right signal generator 210*b* of the $n^{th}$ right stage R_Stage n illustrated in FIG. 9 can be the same as that of the $n^{th}$ right signal generator 210*b* of the $n^{th}$ right stage R_Stage n illustrated in FIG. 6.

Fifth, the $n^{th}$ right signal output unit 220*b* illustrated in FIG. 6 can include only the $n^{th}$ right pull-up transistor R_Tun.

However, the $n^{th}$ right signal output unit 220*b* illustrated in FIG. 9 can include an $n^{th}$ right pull-up transistor R_Tun and an $n_2^{th}$ right pull-up transistor R_Tun_2.

In describing the $n^{th}$ right signal output unit 220*b* illustrated in FIG. 9, the $n^{th}$ right pull-up transistor R_Tun can be referred to as an $n_1^{th}$ right pull-up transistor R_Tun_1. For example, a gate of the $n_1^{th}$ right pull-up transistor R_Tun_1 illustrated in FIG. 9 can be connected to an $n^{th}$ right Q node R_Qn.

A gate of the $n_2^{th}$ right pull-up transistor R_Tun_2 can also be connected to the $n^{th}$ right Q node R_Qn.

Sixth, the $n^{th}$ right signal output unit 220*b* illustrated in FIG. 6 can include only the $n^{th}$ right pull-down transistor R_Tdn.

However, the $n^{th}$ right signal output unit 220*b* illustrated in FIG. 9 can include an $n^{th}$ right pull-down transistor R_Tdn and an $n_2^{th}$ right pull-down transistor R_Tdn_2. The $n_2^{th}$ right pull-down transistor R_Tdn_2 can be connected to the $n_2^{th}$ right pull-up transistor R_Tun_2.

In describing the $n^{th}$ right signal output unit 220*b* illustrated in FIG. 9, the $n^{th}$ right pull-down transistor R_Tdn can be referred to as an $n_1^{th}$ right pull-down transistor R_Tdn_1. In this case, a gate of the $n_1^{th}$ right pull-down transistor R_Tdn_1 illustrated in FIG. 9 can be connected to a gate of an $n+1^{th}$ right ripple transistor R_Trpn+1 included in an $n+1^{th}$ stage.

A gate of the $n_2^{th}$ right pull-down transistor R_Tdn_2 can be connected to a gate of an $n-1^{th}$ right ripple transistor R_Trpn−1 included in an $n-1^{th}$ right stage R_Stage n−1.

For example, the $n^{th}$ left stage L_Stage n and the $n^{th}$ right stage R_Stage n illustrated in FIG. 9 can be connected to two gate lines GL2n−1 and GL2n and can output a gate pulse and a gate off signal to each of the two gate lines GL2n−1 and GL2n.

Hereinafter, a driving method of a display device according to an embodiment of the present disclosure including the stages illustrated in FIG. 9 will be described with reference to FIGS. 9 and 10.

Figure 10:
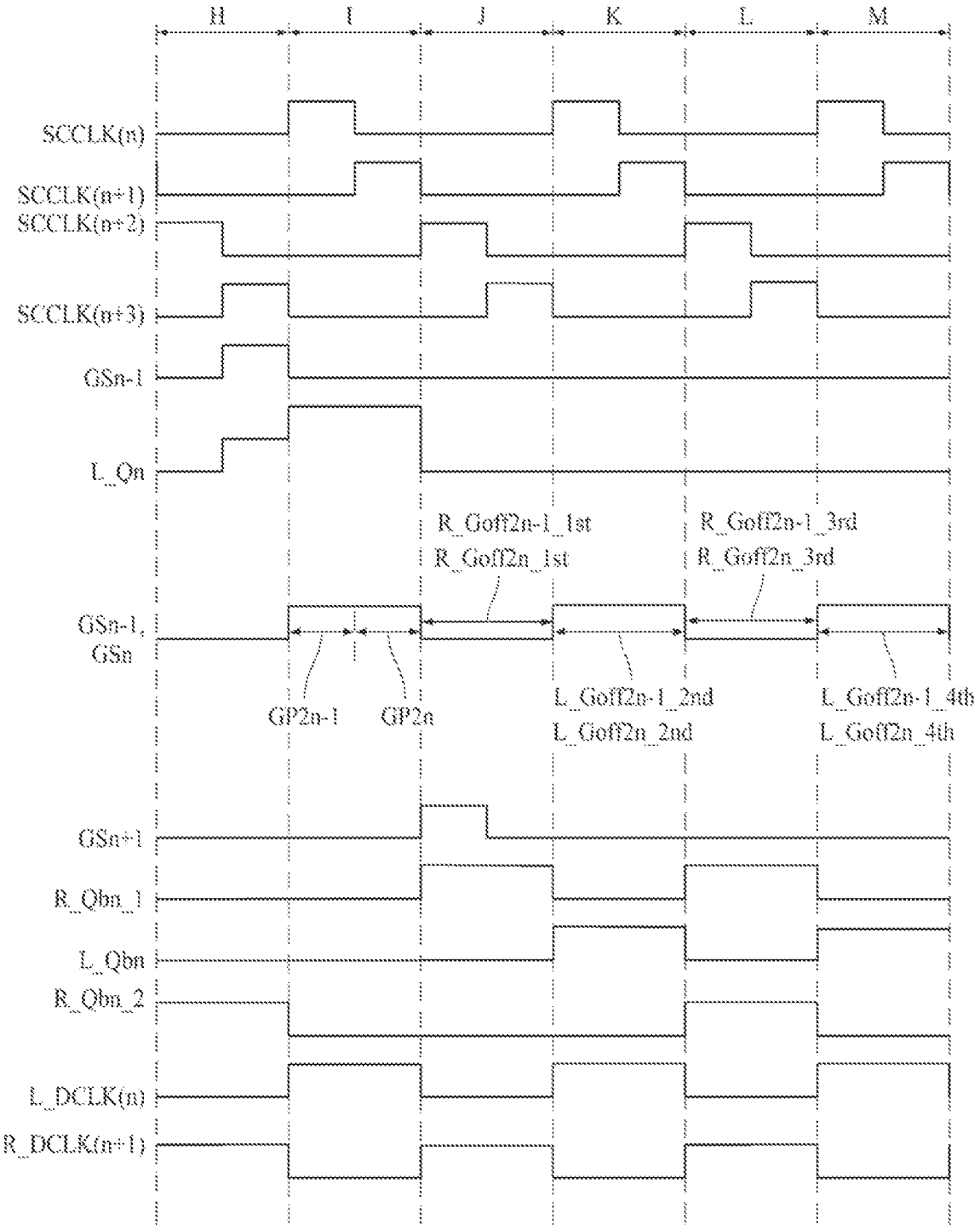
FIG. 10 is a diagram showing waveforms applied to the stages illustrated in FIG. 9.

FIG. 10 is a diagram showing waveforms applied to the stages illustrated in FIG. 9. Hereinafter, the present disclosure will be described with reference to an $n^{th}$ left stage L_Stage n and an $n^{th}$ right stage R_Stage n. In the following description, descriptions which are the same as or similar to descriptions given above with reference to FIGS. 1 to 9 are omitted or will be briefly given.

First, in a first process H, an $n-1^{th}$ gate signal GSn−1 having a high level can be input as a start signal of each of the $n^{th}$ left stage L_Stage n and the $n^{th}$ right stage R_Stage n.

Therefore, an $n^{th}$ left Q node L_Qn and an $n^{th}$ right Q node R_Qn can be charged.

In a second process I, an $n^{th}$ left gate clock L_SCCLK(n) and an $n+1^{th}$ left gate clock L_SCCLK(n+1) can be sequentially shifted to a high level, and an $n^{th}$ right gate clock R_SCCLK(n) and an $n+1^{th}$ right gate clock R_SCCLK(n+1) can be sequentially shifted to a high level. For example, a phase of the $n^{th}$ left gate clock L_SCCLK(n) can be the same as that of the $n^{th}$ right gate clock R_SCCLK(n), and a phase of the $n+1^{th}$ left gate clock L_SCCLK(n+1) can be the same as that of the $n+1^{th}$ right gate clock R_SCCLK(n+1). Therefore, in FIG. 9, the $n^{th}$ left gate clock L_SCCLK(n) and the $n^{th}$ right gate clock R_SCCLK(n) are illustrated as an $n^{th}$ gate clock SCCLK(n), and the $n+1^{th}$ left gate clock L_SCCLK(n+1) and the $n+1^{th}$ right gate clock R_SCCLK(n+1) are illustrated as an $n+1^{th}$ gate clock SCCLK(n+1). In the following description, when it is not required to differentiate the $n^{th}$ left gate clock L_SCCLK(n) from the $n^{th}$ right gate clock R_SCCLK(n), the $n^{th}$ gate clock SCCLK(n) can be used, and when it is not required to differentiate the $n+1^{th}$ left gate clock L_SCCLK(n+1) from the $n+1^{th}$ right gate clock R_SCCLK(n+1), the $n+1^{th}$ gate clock SCCLK(n+1) can be used.

Therefore, a level of the $n^{th}$ left Q node L_Qn can be boosted along with the $n^{th}$ left gate clock L_SCCLK(n) and the $n+1^{th}$ left gate clock L_SCCLK(n+1), and thus, the $n_1^{th}$ left pull-up transistor L_Tun_1 and the $n_2^{th}$ left pull-up transistor L_Tun_2 can be turned on.

Accordingly, a $2n-1^{th}$ gate pulse GP2n−1 and an $2n^{th}$ gate pulse GP2n can be sequentially output to the $2n-1^{th}$ gate line GL2n−1 and the $2n^{th}$ gate line GL2n through the $n^{th}$ left pull-up transistor L_Tun.

In this case, the $2n-1^{th}$ gate pulse GP2n−1 and the $2n^{th}$ gate pulse GP2n can be output from the $n^{th}$ right stage R_Stage n, based on the same method.

Subsequently, in a third process J, an $n+1^{th}$ gate signal GSn+1 having a high level can be input as a reset signal of each of the $n^{th}$ left stage L_Stage n and the $n^{th}$ right stage R_Stage n. Accordingly, the $n_1^{th}$ left pull-up transistor L_Tun_1 and the $n_2^{th}$ left pull-up transistor L_Tun_2 can be turned off.

In this case, the $n_1^{th}$ right pull-up transistor R_Tun_1 and the $n_2^{th}$ right pull-up transistor R_Tun_2 can also be turned off.

Subsequently, in the third process J, an $n+1^{th}$ right ripple clock R_DCLK(n+1) having a high level can be input from an $n+1^{th}$ right stage R_Stage n+1 to an $n^{th}$ right Qb node R_Qbn. Therefore, a $2n-1_1^{th}$ right gate off signal R_Goff2n−1_1st can be output from the $n^{th}$ right stage R_Stage n to a $2n-1^{th}$ gate line GL2n−1. The $2n-1_1^{th}$ right gate off signal R_Goff2n−1_1st can configure a $2n-1^{th}$ right gate off signal.

In this case, an $n-1^{t}$ right ripple clock R_DCLK(n−1) having a high level can be input from the $n-1^{th}$ right stage R_Stage n−1 to an $n_2^{th}$ right Qb node R_Qbn_2. Therefore, a $2n_1^{th}$ right gate off signal R_Goff2n_1st can be output from the $n^{th}$ right stage R_Stage n to the $2n^{th}$ gate line GL2n. The $2n_1^{th}$ right gate off signal R_Goff2n_1st can configure a $2n^{th}$ right gate off signal.

In this case, because the $n^{th}$ left ripple clock L_DCLK(n) having a low level is supplied to the $n^{th}$ left stage R_Stage n, a gate off signal may not be output from the $n^{th}$ left stage R_Stage n.

Subsequently, in a fourth process K, the $n^{th}$ left ripple clock L_DCLK(n) having a high level can be input to the $n^{th}$ left Qb node L_Qbn. Therefore, a $2n-1_2^{th}$ left gate off signal L_Goff2n−1_2nd can be output from the $n^{th}$ left stage R_Stage n to the $2n-1^{th}$ gate line GL2n−1. The $2n-1_2^{th}$ left gate off signal L_Goff2n−1_2nd can configure a $2n-1^{th}$ left gate off signal.

In this case, a $2n_2^{th}$ left gate off signal L_Goff2*n*_2nd can be output from the $n^{th}$ left stage R_Stage n to the $2n^{th}$ gate line GL2n. The $2n_2^{th}$ left gate off signal L_Goff2*n*_2nd can configure a $2n^{th}$ left gate off signal.

In this case, a low level can be continuously supplied to the $n^{th}$ left Q node L_Qn. However, the $n^{th}$ left gate clock L_SCCLK(n) and the $n+1^{th}$ left gate clock L_SCCLK(n+1) each having a high level can be sequentially input to a first terminal of the $n_1^{th}$ left pull-up transistor L_Tun_1 and the $n_2^{th}$ left pull-up transistor L_Tun_2. Accordingly, ripple can occur in the $n^{th}$ left Q node L_Qn due to the $n^{th}$ left gate clock L_SCCLK(n) and the $n+1^{th}$ left gate clock L_SCCLK(n+1) each having a high level.

In this case, because the $n^{th}$ left ripple clock L_DCLK(n) having a high level is supplied to the $n^{th}$ left Qb node L_Qbn, the $n^{th}$ left ripple transistor L_Trpn can be turned on. Therefore, ripple occurring in the $n^{th}$ left Q node L_Qn can be discharged to a terminal, which is supplied with the low voltage GVSS, through the $n^{th}$ left ripple transistor L_Trpn.

In this case, the $n^{th}$ right ripple transistor R_Trpn can be driven based on the same method as the $n^{th}$ left ripple transistor L_Trpn. Accordingly, ripple occurring in the $n^{th}$ right Q node R_Qn can be discharged to a terminal, which is supplied with the low voltage GVSS, through the $n^{th}$ right ripple transistor R_Trpn.

Subsequently, in a fifth process L, the $n+1^{th}$ right ripple clock R_DCLK(n+1) having a high level can be input from the $n+1^{th}$ right stage R_Stage n+1 to an $n_1^{th}$ right Qb node R_Qbn_1. Therefore, a $2n-1_3^{th}$ right gate off signal R_Goff2n−1_3rd can be output from the $n^{th}$ right stage R_Stage n to the $2n-1^{th}$ gate line GL2n−1. The $2n-1_3^{th}$ right gate off signal R_Goff2n−1_3rd can configure a $2n-1^{th}$ right gate off signal.

In this case, the n−1th right ripple clock R_DCLK(n−1) having a high level can be input from the $n-1^{th}$ right stage R_Stage n−1 to the n_2th right Qb node R_Qbn_2. Therefore, a $2n_3^{th}$ right gate off signal R_Goff2n_3rd can be output from the $n^{th}$ right stage R_Stage n to the $2n^{th}$ gate line GL2n. The $2n_3^{th}$ right gate off signal R_Goff2n_3rd can configure a $2n^{th}$ right gate off signal.

Finally, in a sixth process M, the $n^{th}$ left ripple clock L_DCLK(n) having a high level can be input to the $n^{th}$ left Qb node L_Qbn.

Therefore, a $2n-1_4^{th}$ left gate off signal L_Goff2n−1_4th can be output from the $n^{th}$ left stage L_Stage n to the $2n-1^{th}$ gate line GL2n−1. The $2n-1_4^{th}$ left gate off signal L_Goff2n−1_4th can configure a $2n-1^{th}$ gate off signal.

Moreover, a $2n_4^{th}$ left gate off signal L_Goff2n_4th can be output from the $n^{th}$ left stage to the $2n^{th}$ gate line GL2n. The $2n_4^{th}$ left gate off signal L_Goff2n_4th can configure a $2n^{th}$ left gate off signal.

In this case, a low level can be continuously supplied to the $n^{th}$ left Q node L_Qn. However, the $n^{th}$ left gate clock L_SCCLK(n) having a high level can be input to a first terminal of the $n_1^{th}$ left pull-up transistor L_Tun_1, and the $n+1^{th}$ left gate clock L_SCCLK(n+1) having a high level can be input to a first terminal of the $n_2^{th}$ left pull-up transistor L_Tun_2. Accordingly, ripple can occur in the $n^{th}$ left Q node L_Qn due to the $n^{th}$ left gate clock L_SCCLK(n) and the $n+1^{th}$ left gate clock L_SCCLK(n+1) each having a high level.

In this case, because the $n^{th}$ left ripple clock L_DCLK(n) having a high level is supplied to the $n^{th}$ left Qb node L_Qbn, the $n^{th}$ left ripple transistor L_Trpn can be turned on. Therefore, ripple occurring in the $n^{th}$ left Q node L_Qn can be discharged to a terminal, which is supplied with the low voltage GVSS, through the $n^{th}$ left ripple transistor L_Trpn.

In this case, the $n^{th}$ right ripple transistor R_Trpn can be driven based on the same method as the $n^{th}$ left ripple transistor L_Trpn. Accordingly, ripple occurring in the $n^{th}$ right Q node R_Qn can be discharged to a terminal, which is supplied with the low voltage GVSS, through the $n^{th}$ right ripple transistor R_Trpn.

The third to sixth processes J to M can be repeated until another $n^{th}$ gate pulse is output from the $n^{th}$ left stage L_Stage n and the $n^{th}$ right stage R_Stage n, and thus, the $2n-1^{th}$ gate off signal can be continuously output to the $2n-1^{th}$ gate line GL2n−1 and the $2n^{th}$ gate off signal can be continuously output to the $2n^{th}$ gate line GL2n.

In this case, the $2n-1_1^{th}$ right gate off signal R_Goff2n−1_1st, the $2n-1_3^{th}$ right gate off signal R_Goff2n−1_3rd, the $2n-1_2^{th}$ left gate off signal L_Goff2n−1_2nd, and the $2n-1_4^{th}$ left gate off signal L_Goff2n−1_4th can configure a $2n-1^{th}$ gate off signal supplied to the $2n-1^{th}$ gate line.

For example, the $n^{th}$ left stage L_Stage n and the $n^{th}$ right stage R_Stage n can sequentially output the $2n-1^{th}$ gate off signal to the $2n-1^{th}$ gate line GL2n−1. Accordingly, the $2n-1^{th}$ gate off signal can be continuously output to the $2n-1^{th}$ gate line GL2n−1.

In this case, the $2n_1^{th}$ right gate off signal R_Goff2n_1st, the $2n_3^{th}$ right gate off signal R_Goff2n_3rd, the $2n_2^{th}$ left gate off signal L_Goff2n_2nd, and the $2n_4^{th}$ left gate off signal L_Goff2n_4th can configure a $2n^{th}$ gate off signal supplied to the $2n^{th}$ gate line.

For example, the $n^{th}$ left stage L_Stage n and the $n^{th}$ right stage R_Stage n can sequentially output the $2n^{th}$ gate off signal to the $2n^{th}$ gate line GL2n. Accordingly, the $2n^{th}$ gate off signal can be continuously output to the $2n^{th}$ gate line GL2n.

In this case, the $n^{th}$ left ripple transistor L_Trpn which is provided in the $n^{th}$ left stage L_Stage n to remove ripple occurring in the $n^{th}$ left Q node L_Qn of the $n^{th}$ left stage L_Stage n and the $n^{th}$ right ripple transistor R_Trpn which is provided in the $n^{th}$ right stage R_Stage n to remove ripple occurring in the $n^{th}$ right Q node R_Qn of the $n^{th}$ right stage R_Stage n can simultaneously and continuously perform an on operation and an off operation.

Because each of the $n^{th}$ left ripple transistor L_Trpn and the $n^{th}$ right ripple transistor R_Trpn repeats a turn-on operation and a turn-off operation, the $n^{th}$ left ripple transistor L_Trpn and the $n^{th}$ right ripple transistor R_Trpn may not be degraded, and a speed at which the $n^{th}$ left ripple transistor L_Trpn and the $n^{th}$ right ripple transistor R_Trpn are degraded can be reduced. Accordingly, the reliability of the display device according to the present disclosure including the $n^{th}$ left ripple transistor L_Trpn and the $n^{th}$ right ripple transistor R_Trpn can be enhanced.

According to the present disclosure, a ripple transistor for removing ripple occurring in a Q node can repeat an on operation and an off operation, based on a ripple clock. Accordingly, a degradation in the ripple transistor can be prevented, and thus, the reliability of a display device can be enhanced.

According to the present disclosure, a phase of a gate clock supplied to a pull-up transistor connected to the Q node can be the same as that of a ripple clock for driving the ripple transistor. Therefore, even when the gate clock is supplied to the pull-up transistor, an abnormal signal caused by ripple may not be supplied to the Q node. Accordingly, the pull-up transistor connected to the Q node may not abnormally operate, thereby enhancing the reliability of a display device.

According to the present disclosure, because a gate off signal is alternately output from two stages which are provided at both sides of a gate line, the gate off signal can be continuously supplied to the gate line. Therefore, the gate line may not be floated, and thus, switching transistors connected to the gate line may not be abnormally driven. Accordingly, the reliability of a display device can be enhanced.

The above-described feature, structure, and effect of the present disclosure are included in at least one embodiment of the present disclosure, but are not limited to only one embodiment. Furthermore, the feature, structure, and effect described in at least one embodiment of the present disclosure can be implemented through combination or modification of other embodiments by those skilled in the art. Therefore, content associated with the combination and modification should be construed as being within the scope of the present disclosure.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A display device comprising:

a display panel including a display area and a non-display area adjacent to the display area and including gate lines;

a left gate driver provided in a first non-display area of the non-display area to output left gate pulses and left gate off signals to the gate lines; and a right gate driver provided in a second non-display area of the non-display area to output right gate pulses and right gate off signals to the gate lines, wherein the left gate driver comprises an $n^{th}$ left stage outputting an $n^{th}$ left gate pulse and the right gate driver comprises an $n^{th}$ right stage outputting an $n^{th}$ right gate pulse, where n is a natural number, outputs of the $n^{th}$ left gate pulse and the $n^{th}$ right gate pulse are controlled by an $n^{th}$ left Q nodes included in the $n^{th}$ left stage and an $n^{th}$ right Q node included in the $n^{th}$ right stage, and an $n^{th}$ left ripple transistor provided in the $n^{th}$ left stage to remove ripple occurring in the $n^{th}$ left Q node of the $n^{th}$ left stage and an $n^{th}$ right ripple transistor provided in the $n^{th}$ right stage to remove ripple occurring in the $n^{th}$ right Q node of the $n^{th}$ right stage perform an on operation and an off operation repeatedly, and an $n^{th}$ left gate off signal output from the $n^{th}$ left stage and an $n^{th}$ right gate off signal output from the $n^{th}$ right stage are alternately output to an $n^{th}$ gate line.

2. The display device of claim 1, wherein a phase of an $n^{th}$ left gate clock supplied to the $n^{th}$ left stage to generate the $n^{th}$ left gate pulse is the same as a phase of an $n^{th}$ left ripple clock supplied for driving the $n^{th}$ left ripple transistor, and a phase of an $n^{th}$ right gate clock supplied to the $n^{th}$ right stage to generate the $n^{th}$ right gate pulse is the same as a phase of an $n^{th}$ right ripple clock supplied for driving the $n^{th}$ right ripple transistor.

3. The display device of claim 1, wherein a phase of an $n^{th}$ left ripple clock supplied for driving the $n^{th}$ left ripple transistor is the same as a phase of an $n^{th}$ right ripple clock supplied for driving the $n^{th}$ right ripple transistor.

4. The display device of claim 1, wherein a first terminal of the $n^{th}$ left ripple transistor is connected to the $n^{th}$ left Q node, a second terminal of the $n^{th}$ left ripple transistor is connected to a first voltage terminal, and a gate of the $n^{th}$ left ripple transistor is connected to a gate of an $n^{th}$ left pull-down transistor which controls an output of the of an $n^{th}$ left gate off signal, and a first terminal of the $n^{th}$ right ripple transistor is connected to the $n^{th}$ right Q node, a second terminal of the $n^{th}$ right ripple transistor is connected to the first voltage terminal, and a gate of the $n^{th}$ right ripple transistor is connected to a terminal which is supplied with an $n^{th}$ right ripple clock.

5. The display device of claim 4, wherein a phase of an $n^{th}$ left gate clock supplied to the $n^{th}$ left stage to generate the $n^{th}$ left gate pulse is the same as a phase of an $n^{th}$ left ripple clock supplied for driving the $n^{th}$ left ripple transistor, and a phase of an $n^{th}$ right gate clock supplied to the $n^{th}$ right stage to generate the $n^{th}$ right gate pulse is the same as a phase of the $n^{th}$ right ripple clock supplied to a gate of the $n^{th}$ right ripple transistor.

6. The display device of claim 4, wherein an $n^{th}$ left ripple clock is supplied to a gate of the $n^{th}$ left ripple transistor, the $n^{th}$ right ripple clock is supplied to a gate of the $n^{th}$ right ripple transistor, and a phase of the $n^{th}$ left ripple clock is the same as a phase of the $n^{th}$ right ripple clock.

7. The display device of claim 4, wherein a gate of the $n^{th}$ left ripple transistor is connected to a gate of an $n^{th}$ left pull-down transistor which controls an output of the $n^{th}$ left gate off signal, and a gate of the $n^{th}$ right ripple transistor is not connected to a gate of an $n^{th}$ right pull-down transistor which controls an output of the $n^{th}$ right gate off signal.

8. The display device of claim 7, wherein a gate of the $n^{th}$ right pull-down transistor is connected to a gate of an $n+1^{th}$ right ripple transistor included in an $n+1^{th}$ right stage.

9. The display device of claim 1, wherein, when the $n^{th}$ left ripple transistor is turned on, the $n^{th}$ left gate off signal is output from the $n^{th}$ left stage to the $n^{th}$ gate line, and when the $n^{th}$ right ripple transistor is turned off, the $n^{th}$ right gate off signal is output from the $n^{th}$ right stage to the $n^{th}$ gate line.

10. The display device of claim 1, wherein outputs of the $n^{th}$ left gate off signal and the $n^{th}$ right gate off signal are controlled by an $n^{th}$ left Qb node included in the $n^{th}$ left stage and an $n^{th}$ right Qb node included in the $n^{th}$ right stage, a gate of the $n^{th}$ left ripple transistor and the $n^{th}$ left Qb node included in the $n^{th}$ left stage are connected to each other, and the $n^{th}$ right Qb node included in the $n^{th}$ right stage is connected to a gate of an $n+1^{th}$ right ripple transistor included in an $n+1^{th}$ right stage.

11. A display device comprising:

a display panel including a display area and a non-display area adjacent to the display area and including gate lines;

a left gate driver provided in a first non-display area of the non-display area to output left gate pulses and left gate off signals to the gate lines; and a right gate driver provided in a second non-display area of the non-display area to output right gate pulses and right gate off signals to the gate lines, wherein the left gate driver comprises an $n^{th}$ left stage outputting an $n^{th}$ left gate pulse and the right gate driver comprises an $n^{th}$ right stage outputting an $n^{th}$ right gate pulse, where n is a natural number, outputs of the $n^{th}$ left gate pulse and the $n^{th}$ right gate pulse are controlled by an $n^{th}$ left Q nodes included in the $n^{th}$ left stage and an $n^{th}$ right Q node included in the $n^{th}$ right stage, an $n^{th}$ left ripple transistor provided in the $n^{th}$ left stage to remove ripple occurring in the $n^{th}$ left Q node of the $n^{th}$ left stage and an $n^{th}$ right ripple transistor provided in the $n^{th}$ right stage to remove ripple occurring in the $n^{th}$ right Q node of the $n^{th}$ right stage perform an on operation and an off operation repeatedly, and wherein the $n^{th}$ left stage comprises an $n^{th}$ left signal generator including the $n^{th}$ left ripple transistor and an $n^{th}$ left signal output unit configured to output an $n^{th}$ left gate off signal and the $n^{th}$ left gate pulse, based on an $n^{th}$ left control signal generated by the $n^{th}$ left signal generator, the $n^{th}$ right stage comprises an $n^{th}$ right signal generator including the $n^{th}$ right ripple transistor and an $n^{th}$ right signal output unit configured to output an $n^{th}$ right gate off signal and the $n^{th}$ right gate pulse, based on an $n^{th}$ right control signal generated by the $n^{th}$ right signal generator, and the $n^{th}$ left gate off signal and the $n^{th}$ right gate off signal are alternately output.

12. The display device of claim 11, wherein the $n^{th}$ left signal output unit comprises an $n^{th}$ left pull-up transistor outputting the $n^{th}$ left gate pulse, a gate of the $n^{th}$ left pull-up transistor being connected to the $n^{th}$ left Q node, and the $n^{th}$ right signal output unit comprises an $n^{th}$ right pull-up transistor outputting the $n^{th}$ right gate pulse, a gate of the $n^{th}$ right pull-up transistor being connected to the $n^{th}$ right Q node.

13. The display device of claim 12, wherein the $n^{th}$ left signal output unit comprises an $n^{th}$ left pull-down transistor outputting the $n^{th}$ left gate off signal, a gate of the $n^{th}$ left pull-down transistor being connected to a gate of the $n^{th}$ left ripple transistor, and the $n^{th}$ right signal output unit comprises an $n^{th}$ right pull-down transistor outputting the $n^{th}$ right gate off signal, a gate of the $n^{th}$ right pull-down transistor being connected to a gate of an $n+1^{th}$ right ripple transistor included in an $n+1^{th}$ right stage.

14. The display device of claim 13, wherein the $n^{th}$ left signal output unit further comprises an $n_2^{th}$ left pull-up transistor, a gate of the $n_2^{th}$ left pull-up transistor being connected to the $n^{th}$ left Q node, where g is an even number, and n is a natural number of g/2, and the $n^{th}$ right signal output unit further comprises an n_2th right pull-up transistor, a gate of the $n_2^{th}$ right pull-up transistor being connected to the $n^{th}$ right Q node.

15. The display device of claim 14, wherein the $n^{th}$ left signal output unit further comprises an $n_2^{th}$ left pull-down transistor connected to the $n_2^{th}$ left pull-up transistor, a gate of the $n_2^{th}$ left pull-down transistor is connected to a gate of the $n^{th}$ left ripple transistor, the $n^{th}$ right signal output unit further comprises an $n_2^{th}$ right pull-down transistor connected to the $n_2^{th}$ right pull-up transistor, and a gate of the $n_2^{th}$ right pull-down transistor is connected to a gate of an $n-1^{th}$ right ripple transistor included in an $n-1^{th}$ right stage.

16. A display device comprising:

a display panel including a display area and a non-display area adjacent to the display area and including gate lines;

a left gate driver provided in a first non-display area of the non-display area to output left gate pulses and left gate off signals to the gate lines; and a right gate driver provided in a second non-display area of the non-display area to output right gate pulses and right gate off signals to the gate lines, wherein the left gate driver comprises an $n^{th}$ left stage outputting an $n^{th}$ left gate pulse and the right gate driver comprises an $n^{th}$ right stage outputting an $n^{th}$ right gate pulse, where n is a natural number, outputs of the $n^{th}$ left gate pulse and the $n^{th}$ right gate pulse are controlled by an $n^{th}$ left Q nodes included in the $n^{th}$ left stage and an $n^{th}$ right Q node included in the $n^{th}$ right stage, an $n^{th}$ left ripple transistor provided in the $n^{th}$ left stage to remove ripple occurring in the $n^{th}$ left Q node of the $n^{th}$ left stage and an $n^{th}$ right ripple transistor provided in the $n^{th}$ right stage to remove ripple occurring in the $n^{th}$ right Q node of the $n^{th}$ right stage perform an on operation and an off operation repeatedly, wherein, when the $n^{th}$ left ripple transistor is turned on, the $n^{th}$ left gate off signal is output from the $n^{th}$ left stage to the $n^{th}$ gate line, and when the $n^{th}$ right ripple transistor is turned off, the $n^{th}$ right gate off signal is output from the $n^{th}$ right stage to the $n^{th}$ gate line.

* * * * *